US011781826B2

(12) United States Patent
Grünewald et al.

(10) Patent No.: US 11,781,826 B2
(45) Date of Patent: Oct. 10, 2023

(54) RETAINING APPARATUS FOR AMMUNITION BODIES

(71) Applicant: KRAUSS-MAFFEI WEGMANN GMBH & CO. KG, Munich (DE)

(72) Inventors: Jens Grünewald, Munich (DE); Eric Prummenbaum, Munich (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 17/800,112

(22) PCT Filed: Feb. 18, 2021

(86) PCT No.: PCT/EP2021/054004
§ 371 (c)(1),
(2) Date: Aug. 16, 2022

(87) PCT Pub. No.: WO2021/165384
PCT Pub. Date: Aug. 26, 2021

(65) Prior Publication Data

US 2023/0074465 A1 Mar. 9, 2023

(30) Foreign Application Priority Data

Feb. 20, 2020 (DE) ..... 10 2020 104 467.4

(51) Int. Cl.
*F41A 9/11* (2006.01)
*F41A 9/02* (2006.01)
(Continued)

(52) U.S. Cl.
CPC ..... *F41A 9/11* (2013.01); *F41A 9/02* (2013.01); *F41A 9/03* (2013.01); *F42B 39/28* (2013.01)

(58) Field of Classification Search
CPC ..... F41A 9/02; F41A 9/03; F41A 9/10; F41A 9/11; F42B 39/28
(Continued)

(56) References Cited

U.S. PATENT DOCUMENTS 3,670,863 A * 6/1972 Meier ..... F41A 9/04 89/33.03
3,704,772 A * 12/1972 Meier ..... F41A 9/02 414/217
4,344,350 A * 8/1982 Golden ..... F41A 9/51 198/594

FOREIGN PATENT DOCUMENTS

CH 278191 1/1952
DE 2501425 A1 7/1975
(Continued)

OTHER PUBLICATIONS

International Search Report pertaining to PCT Application No. PCT/EP2021/054004 dated May 12, 2021, 4 pages.
(Continued)

*Primary Examiner* — Bret Hayes
(74) *Attorney, Agent, or Firm* — Thompson Hine LLP

(57) ABSTRACT

A holding device for munition bodies, having two holding shells which are movable relative to one another and which form a holding region in which a munition body can be held, wherein the holding shells are rotatable about a common axis of rotation, wherein the axis of rotation of the holding shells runs through the holding region. Moreover, the disclosure relates to a magazine having a holding device, to a projectile lift having a holding device, and to a method for holding munition bodies.

14 Claims, 11 Drawing Sheets

(51) Int. Cl.
*F41A 9/03* (2006.01)
*F42B 39/28* (2006.01)

(58) Field of Classification Search
USPC ..... 89/33.01, 33.2, 33.25, 33.5, 35.01
See application file for complete search history.

(56) References Cited

FOREIGN PATENT DOCUMENTS

| | | | |
|---|---|---|---|
| DE | 3046642 | A1 | 7/1982 |
| DE | 3025501 | C1 | 7/1985 |
| DE | 4126199 | A1 | 11/1993 |

OTHER PUBLICATIONS

International Preliminary Report on Patentability dated Sep. 1, 2022, which pertains to PCT Application No. PCT/EP2021/054004, filed Feb. 18, 2021. 7 pages.

* cited by examiner

RETAINING APPARATUS FOR AMMUNITION BODIES

This application is a national stage filing of International (PCT) Application No. PCT/EP2021/054004, corresponding to International Publication No. WO 2021/165384 filed on Feb. 18, 2021, which in turn claims priority to German Application No. 10 2020 104 467.4 filed on Feb. 20, 2020. The entire contents of both of those applications are hereby incorporated by reference.

The disclosure relates to a retaining apparatus for ammunition bodies having two retaining shells which are movable relative to one another and which form a retaining region in which an ammunition body can be held, wherein at least one retaining shell can be rotated about a rotation axis. Furthermore, the disclosure relates to a magazine having a retaining apparatus, an ammunition elevator having a retaining apparatus and a method for retaining ammunition bodies.

BACKGROUND

Retaining apparatuses of this kind are inserted into ammunition magazines, for example, in order to hold the corresponding ammunition bodies securely at a storage space. Particularly in military vehicles, there is a risk of ammunition bodies being able to slip or get wedged, and this can be prevented by corresponding retaining apparatuses.

From a structural point of view, retaining apparatuses of this kind usually have two movable retaining shells which form a retaining region in which an ammunition body can be held. The retaining region is located between the two retaining shells and corresponds to the cross section of the ammunition body being held when the retaining apparatus is closed.

One, or possibly also both, retaining shells can often be rotated back and forth about a rotation axis between a closed or retaining position and an open or transfer position, and the retaining apparatus is therefore configured in the manner of gripping pliers. When the gripping pliers are open, ammunition bodies can be inserted in said gripping pliers or removed therefrom, and when the gripping pliers are closed, the ammunition body is received between the two gripping jaws or the retaining shells of the pliers and is then no longer movable in respect of the retaining apparatus.

Although gripping pliers of this kind have clearly proved successful, they require a relatively large amount of space. This is because the distance of the rotation axis of the retaining shell from the longitudinal axis of the ammunition bodies is relatively large, so that the retaining shell is moved relatively far away from the ammunition body when the pliers are opened and, to this extent, a certain region alongside the retaining shells must be kept ready for opening.

SUMMARY

On this basis, a problem addressed by the current disclosure is that of specifying a retaining apparatus for ammunition bodies having a smaller space requirement and a corresponding method for retaining ammunition bodies.

This problem can be solved in the case of a retaining apparatus of the kind referred to above, in that the rotation axis of the retaining shell runs through the retaining region.

This embodiment allows an opening and closing of the retaining device with a smaller space requirement. This is because since the rotation axis of the retaining shell runs through the retaining region, the distance of the longitudinal axis of the ammunition body from the rotation axis of the retaining shell, and therefore also the space required for opening, is reduced by comparison with the pliers solution. This also means that the retaining shell need not be moved as far away from the ammunition body for the opening and closing of the retaining apparatus.

It has proved advantageous for both retaining shells to be rotatable about a joint rotation axis. This enables there to be a rapid opening and closing of the retaining apparatus or a rapid rotation of the retaining shells between the retaining position and the transfer position.

Furthermore, it has proved advantageous for the rotational axis of the retaining shell to be aligned with the longitudinal axis of an ammunition body which is being held. This embodiment allows an opening and closing of the retaining apparatus, without there being an additional space requirement. Both retaining shells can move in a round contour during opening and closing and the distance of the retaining shells from the rotation axis can remain constant in this case. The rotation axis can run through the middle of the retaining region. Since ammunition bodies are rotationally symmetrical, the retaining region also has a correspondingly round contour, which can coincide with the outer diameter of the ammunition bodies.

It has furthermore proved advantageous for the retaining apparatus to be able to receive the ammunition bodies in a horizontal position. Particularly in magazines in military vehicles, it has proved successful for the ammunition bodies to be arranged horizontally, since the ammunition bodies are then substantially more accessible by contrast with upright storage. Furthermore, horizontal ammunition bodies are usually also already pointing in the firing direction in a military vehicle, meaning that the ammunition bodies can be inserted into the barrel comparatively easily and do not have to be turned through 90 degrees in elevation first.

With regard to the design of the retaining shells, it has proved to be advantageous if they are designed as cylinder segments. It may be advantageous if the central axes of the cylinder segments correspond to the rotation axis. This design allows reliable accommodation of ammunition bodies, as they are also cylindrical.

Furthermore, it has proved to be advantageous if the segment angles of the retaining shells add up to no more than 180 degrees. Due to this design, simple ejection of the ammunition body from the retaining shells is achieved. The segment angle refers to the angle that includes the connection of one end of a retaining shell in cross-section to the rotation axis and the connection of the corresponding other end to the rotation axis. The corresponding connections are at right angles to the rotation axis. The larger the segment angle(s), the more contact surface is available for the ammunition bodies and the more stable are the retaining shells. The segment angle must therefore be sufficiently large so that even heavier ammunition bodies can be safely received and retained. In this respect, it may be advantageous if the sum of the segment angles of the two retaining shells is between 90 and 180 degrees, in one case between 140 and 180 degrees, more specifically between 170 and 180 degrees and more specifically between 175 and 180 degrees.

According to an advantageous design, the retaining shells have different segment angles. The retaining shell with the larger segment angles can carry correspondingly more weight than the retaining shell with the smaller segment angle. In this respect, the retaining shell with the larger segment angle may be arranged in the retaining position below the ammunition body and the retaining shell with the smaller segment angle may be arranged above the ammunition body. The segment angle of the one retaining shell may be between 90 and 175 degrees, in one case between 100 and 160 degrees, more specifically between 110 and 140 degrees and more specifically between 115 and 130 degrees. In practice, a segment angle of 120 degrees has proved to be advantageous. The segment angle of the other retaining shell can be between 30 and 100 degrees, in one case between 40 and 80 degrees and more specifically between 50 and 70 degrees. In practice, 60 degrees has proved to be beneficial.

According to further development, it is proposed that the two retaining shells can be rotated relative to each other around the rotation axis. In order to open the retaining apparatus and transfer it to the transfer position, in which the ammunition bodies can be inserted into the retaining apparatus or into the retaining region, the two retaining shells can be moved relative to each other around the rotation axis. In order to close the opened retaining shell which is in the transfer position, so that the ammunition body is then retained in the retaining shell or in the retaining region, the two retaining shells can be moved in the opposite direction.

For moving the retaining shells, it may be advantageous if they can be moved relative to each other by means of a retaining shell drive. One retaining shell drive offers advantages over movement of the retaining shells with two drives, especially with regard to costs. In this respect, it may be advantageous if the retaining shells are movable relative to each other by means of a single common retaining shell drive. Furthermore, the use of only one drive also reduces the probability of failure. The movements of the retaining shells can be force-coupled, so that a movement of one retaining shell leads to a movement of the other retaining shell. The two retaining shells are then not movable freely and independently of each other, so that firmly defined retaining positions and transfer positions result. The coupling also prevents one of the two retaining shells from moving unintentionally, thus reducing the risk that an ammunition body in the retaining position will not be retained securely or cannot be removed from the retaining apparatus or introduced into the retaining apparatus in the transfer position.

In this respect, it also may be advantageous if the two retaining shells are movable in opposite directions. If, for example, one of the retaining shells is rotated clockwise around the rotation axis, the other retaining shell can be rotated counterclockwise.

To realize the movement of the retaining shells, it is proposed that the retaining shell drive is connected to both retaining shells via a gearbox. The gearbox can ensure that the two retaining shells can be moved in the opposite direction relative to each other with just one drive.

From a design point of view, it has proved to be advantageous if the gearbox is arranged in an end region of the retaining shells. The gearbox is therefore easily accessible from the outside, which simplifies maintenance. The gearbox may be arranged at the end region of the retaining shells where the rear end of the ammunition bodies is accommodated. In this respect, the gearbox can then bound the retaining region to the rear. Alternatively, it is also possible to arrange the gearbox as well as the retaining shell drive at the front end of the retaining shells.

Furthermore, the retaining shells at the opposite end region can be mounted on a rotary bearing. Due to such a bearing on both sides of the retaining shells, the acting forces can be absorbed reliably. The retaining region or the retained ammunition bodies may be located between the two retaining shells and between the rotary bearing and the gearbox. In this respect, the ammunition bodies are then retained in the retaining apparatus securely in the retaining position in each direction and cannot move.

With regard to the design of the gearbox, it has proved to be advantageous if it is designed as a planetary gearbox. A planetary gearbox enables a contrarotating movement of the two retaining shells around a common rotation axis with only one drive in a simple design.

The planetary gearbox can have a hollow wheel with internal toothing and a sun wheel with external toothing. Between the hollow wheel and the sun wheel, multiple planetary wheels may be provided, which mesh with the hollow wheel and with the sun wheel. For uniform power transmission, three evenly distributed planetary gears have proved to be advantageous. The sun wheel and the hollow wheel can both be rotatable around the rotation axis.

The planetary gears can be rotatably mounted on a bridge and connected to each other, so that they cannot move relative to each other. The retaining shell drive can be connected to the bridge, for example by a screw connection. When the sun wheel is rotated in one direction around the rotation axis, the planetary gears ensure that the hollow wheel rotates in the opposite direction. The hollow wheel can be connected to one of the retaining shells and the sun wheel can be connected to the other retaining shell so that both retaining shells can then rotate in opposite directions around the rotation axis. Alternatively, it is also possible to drive the hollow wheel by means of the retaining shell drive. Then the sun wheel rotates accordingly in the opposite direction.

In addition to the relative movement of the two retaining shells, it has also proved to be advantageous if the two retaining shells can be rotated together around the rotation axis by means of a rotary drive. This allows a wider range of applications of the retaining apparatus. By a corresponding rotation, it is further achieved that ammunition bodies are introduced into the retaining apparatus from any direction in the transfer position or that ammunition bodies can be ejected from the retaining apparatus in any direction. Furthermore, the two retaining shells in the transfer position can be transferred to a grabbing position by a joint rotation around the rotation axis and oriented in such a way that they can grab an ammunition body from above. If the retaining apparatus or the two retaining shells are then transferred from this grabbing position to the retaining position, the ammunition body is secured in the retaining apparatus and can then be moved, for example, together with the retaining apparatus. In this respect, ammunition bodies can also be grabbed with the retaining apparatus and the retaining apparatus can be designed as a type of grabber. The grabbing position therefore corresponds to a transfer position in which both retaining shells were rotated together around the rotation axis by 90 degrees.

Due to the rotation of the two retaining shells, ammunition bodies can be ejected from the retaining apparatus in any direction, in particular to the right and left. This is particularly advantageous if the retaining apparatus is used in an ammunition elevator or in a magazine.

The two retaining shells can be rotated together around the rotation axis without moving relative to each other, i.e. are relatively free of movement. The rotary drive can rotate the retaining shell drive, the gearbox and both retaining shells together around the rotation axis for this purpose. The planetary gears of the gearbox can be coupled to the rotary drive via the bridge. For this purpose, the bridge can, for example, be connected to a gear ring, which can be rotated by the rotary drive. The rotary drive can be arranged above the retaining shell drive.

With regard to the retaining shells, it has proved to be advantageous if the two retaining shells are opposite each other in a retaining position in such a way that an ammunition body is retained between the two retaining shells and the two retaining shells are arranged in a transfer position in such a way that an ammunition body can be ejected from the two retaining shells. In the retaining position, the ammunition body may lie in one of the two retaining shells, in particular in the larger retaining shell, and the other retaining shell may be opposite the retaining shell and thus secure the ammunition body. In this way, the ammunition bodies can be retained in a form-fitting way. The two retaining shells are then arranged on opposite sides of the ammunition body. In order to remove the ammunition body from the retaining apparatus or to eject it from the retaining apparatus, the two retaining shells can be moved to the transfer position in which the ammunition body is no longer secured.

Furthermore, it has proved to be advantageous if the two retaining shells are in contact with each other in the transfer position. Due to this position of the two retaining shells, it is achieved that ammunition bodies can be removed from the retaining apparatus or inserted into the retaining apparatus. If the two retaining shells are in contact with each other, the form fit is removed accordingly. The two retaining shells can be in contact with each other edge to edge, but in the transfer position the two retaining shells can also be in contact with each other in such a way that they are at least partially arranged one behind the other and overlap. Since the grabbing position basically only corresponds to a rotated transfer position, in the grabbing position the two retaining shells can be in contact with each other accordingly.

In order to simplify the removal of ammunition bodies, it has proved to be advantageous if one of the retaining shells has an ejection device for ejecting an ammunition body. A certain force can be applied to an ammunition body by means of the ejection device, which facilitates the removal or ejection of the ammunition body. The ejection device can be designed as an ejection latch and in particular as a spring. Due to the design as a spring, no additional activation or electrical energy is required to eject the ammunition body from the retaining apparatus. When inserting or receiving the ammunition body, the ammunition body can preload the ejection device so that it then ensures that the ammunition body is ejected from the retaining apparatus when the retaining shells are transferred to the transfer position. The ejection device may be arranged in the retaining shell with the larger segment angle, since the main load of the ammunition body can weigh on this retaining shell. It may be advantageous if the ejection device is arranged in the region of the center of gravity of the ammunition body, in particular in the middle of the retaining shell. However, it is also possible to provide for multiple ejection devices distributed over the length of the retaining shell. As a result, reliable ejection of the ammunition body can be achieved without it tilting. The longitudinal axis of the ammunition body then remains parallel to the rotation axis of the retaining shells.

Furthermore, it has proved to be advantageous if an ejection mechanism with at least one ejection latch and an ejection drive for moving the ejection latch is provided. The ejection latch can be moved by means of the ejection drive and thus the ammunition body can be ejected from the retaining shell.

The ejection mechanism can be designed in such a way that the ejection latch can be operated by means of a relative movement of the retaining rollers. The ejection latch can thus be force-coupled to the retaining rollers so that the ammunition bodies are ejected automatically if the retaining rollers take up a predefined position, in particular the transfer position.

The ejection latch may have two latch elements connected to the retaining shell at one end, which are swiveled to eject an ammunition body. It may be advantageous if the two latch elements are swiveled towards each other or at least one latch element is swiveled towards the other latch element. For example, one latch element may be swiveled clockwise and the other latch element may be swiveled counterclockwise. At the end not connected to the retaining shell, the latch elements may have rollers that can ensure that the ammunition body is reliably ejected and does not jam. If the ammunition body is in the retaining shell, the ends of the latch elements or the rollers may be in contact with the lower half of the ammunition body, so that when the latch elements are swiveled, the ammunition body is moved away from the retaining shell in which the latch elements are supported.

Furthermore, it has proved to be advantageous if the ejection mechanism is designed in such a way that the ammunition bodies are ejected in a certain direction regardless of gravity. In this respect, the ammunition bodies can be ejected from the retaining shells not only downwards, but also, for example, laterally and to a certain extent upwards.

Furthermore, it has proved to be advantageous if the ejection latch protrudes over the edge of the lower retaining shell. The ejection latch may thus have a larger segment angle than the retaining shell, in particular than the retaining shell with the larger segment angle. In this respect, the ammunition body can also be additionally secured in the retaining shell by the ejection latch.

With regard to the reliable ejection of the ammunition bodies, it has proved to be advantageous if multiple, in particular three, ejection latches are provided. One ejection latch may be provided for the rear region of the ammunition body and two ejection latches for the front region of the ammunition body.

According to an advantageous development, it is provided that the ejection drive has a toothed segment coupled to one of the two retaining shells and an ejection pinion rotatably connected to the other retaining shell, wherein with a relative movement of the retaining shells, the toothed segment rotates the ejection pinion and thereby actuates the ejection latch. In this respect, the ejection of the ammunition bodies can be positively controlled by the relative movement of the retaining shells. No additional motor is required to drive the ejection latches. The ejection pinion can, for example, be rotationally coupled by means of a rod coupling to one or more ejection latches. In particular, the ejection pinion is rotationally coupled to at least one latch element, so that when the ejection pinion is rotated by the toothed segment, the latch element is also rotated accordingly and the ammunition body is basically ejected automatically.

The toothed segment may be designed in such a way that it does not act on the ejection pinion in a certain rotation region of the retaining shell and actuates the ejection pinion in another rotation region. The retaining shells can thus be moved relative to each other in a certain region without the ejection latches being activated. This goes hand in hand with the fact that the ammunition body can only be ejected when the retaining shells have been rotated far enough. In practice, for example, it has proved to be advantageous if the toothed segment only comes into contact with the ejection pinion when the retaining shells only have to be rotated relative to each other by less than 45 degrees, in particular by less than 30 degrees, in one case by less than 25 degrees and more specifically by 22 degrees until they are in contact with each other. The ejection latches are then only activated in this last swivel range.

It also may be advantageous if the toothed segment comes into contact with a different ejection pinion during a clockwise rotational movement of the retaining shell rather than with a counterclockwise rotational movement. Thus, an ejection pinion may be provided for an ejection to the right and an ejection pinion may be provided for an ejection to the left.

It also may be advantageous if the toothed segment and the drive pinion are not arranged within the retaining region, so that this is not reduced or impaired. A toothed segment may be provided in the front region of the retaining shell and another toothed segment may be provided in the rear region of the retaining shell. The same can also apply to the ejection pinions, wherein there may be two pinions in both the front and rear regions, one for an ejection to the right and one for an ejection to the left.

In particular, if the retaining shells are adapted to the contour of the ammunition bodies and then do not have the same distance from each other or from the rotation axis, in particular in the front and rear regions, it may be necessary that the ratios between the front toothed segment and the front ejection pinions and between the rear toothed segment and the rear ejection pinions are not the same. In this respect, the number of teeth of the front and rear toothed segments and/or the number of teeth of the front and rear ejection pinions may be different. Due to this design, it can be achieved that the ejection latches or the latch elements of the ejection latches are swiveled in the same direction during a rotational movement of the retaining shells.

According to a further development, it is proposed that the retaining shells are designed in such a way that they are adapted to the contour of the ammunition body to be retained. Due to this adaptation, it can be ensured that the ammunition body cannot move between the two retaining shells and is therefore retained securely. The distance between the retaining shells and the rotation axis may be greater in the rear region of the retaining shells than in the front region. This goes hand in hand with the fact that the ammunition bodies are also narrower in the front region than in the rear region due to the aerodynamics. In this respect, the retaining region can be ammunition body-shaped.

The retaining shells can extend over the entire length of the projectile. The retaining shells may have a length of at least 300 mm, in one case at least 500 mm, in another case at least 700 mm, in another case at least 900 mm, in another case at least 1100 mm and in yet another case at least 1300 mm. The retaining shells and the retaining region can be designed to accommodate 120 mm caliber ammunition.

The ammunition bodies can be designed as large-caliber ammunition bodies that can be fired through the weapon barrel of a military vehicle. For example, they can be projectiles with a caliber of 120 mm. It can be cartridge ammunition, cartridge ammunition with a propellant charge separated from the projectile or propellants or projectiles themselves. In particular, it is lethal ammunition.

The above-mentioned problem may be solved in a method for retaining ammunition bodies with a retaining apparatus exhibiting two retaining shells which are movable relative to one another and which form a retaining region in which an ammunition body is held, wherein at least one of the two retaining shells is rotated about a rotation axis running through the retaining region.

It may be advantageous if the retaining apparatus is designed in the manner described above. The can result in the advantages already described with regard to the retaining apparatus.

Furthermore, with the regard to the above-mentioned problem, the disclosure relates to a magazine having a retaining apparatus, which is designed in the manner described above.

The magazine may have two, in particular parallel, base plates, between which the retaining apparatus or the retaining shells respectively are rotatably mounted. For mounting, the base plates can have a hole pattern with several holes. The retaining apparatus can be inserted into the corresponding holes.

The rotary bearing can be mounted in one base plate and the gearbox can be mounted in the other base plate. The gearbox can be connected to the base plate via the bridge so that the bridge cannot move relative to the base plate. The bridge can be bolted to the base plate for this purpose. The rotation axis of the retaining shells can be arranged perpendicular to the two base plates.

Furthermore, it may be advantageous if the magazine is designed in the manner described below. Also, with regard to the magazine, a method for storing ammunition bodies is proposed below.

For the storage of ammunition bodies, the magazine can have multiple storage spaces arranged next to each other, wherein the storage spaces are each assigned a retaining apparatus for retaining an ammunition body, wherein a conveying device for conveying an ammunition body from one retaining apparatus to an adjacent retaining apparatus can be used.

With this design ensures it is achieved that individual ammunition bodies can be moved back and forth between the various storage spaces independently of the other ammunition bodies. It is therefore not necessary to move all ammunition bodies and retaining apparatuses, but an ammunition body can be selected and then moved to the removal position independently of the other ammunition bodies.

With regard to the removal, it has proved to be advantageous if the ammunition bodies are stored or supported horizontally in the magazine. Due to this design, the ammunition bodies are easier to access than, for example, with upright storage and in addition the ammunition bodies usually have to be fed to the weapon in a horizontal position anyway, so that horizontal storage also simplifies the downstream loading process of the weapon.

Furthermore, it has proved to be advantageous if the magazine has multiple storage levels arranged one above the other, wherein each storage level includes multiple storage spaces. This design leads to dense ammunition body packing, so that the available space is used as well as possible. The number of storage levels and the number of storage spaces per level can thus be adapted to the prevailing space conditions. In practice, for example, three storage levels with eight storage spaces each have proved to be advantageous for military vehicles. This would then correspond to a capacity of 24 ammunition bodies. Nevertheless, only one storage space may be provided at each storage level.

Multiple storage levels have also proved to be advantageous with regard to different ammunition bodies. This is because it is possible that each level is assigned a certain type of ammunition body, so that when selecting an ammunition body or an ammunition body type, this can be removed from the corresponding level without having to move the ammunition bodies of the other levels.

In order to move the ammunition bodies of the different levels to a removal position, it has proved to be advantageous if an ammunition elevator is provided. In the case of ammunition loading, the ammunition elevator can transport the ammunition bodies to be stored to their corresponding storage level and then transfer them back from the storage level to a removal position when the ammunition bodies are removed. It may be advantageous if the magazine has a common removal position for multiple ammunition bodies, in particular a common removal position for all ammunition bodies for the removal of the ammunition bodies from the magazine. The ammunition bodies can only be removed from the magazine at a firmly defined point and only at this point will a suitable space or a suitable removal space be required in the direction of removal after the magazine.

It has further proved to be advantageous if the magazine has two storage areas, wherein an ammunition elevator is arranged between the two storage areas for conveying the ammunition bodies between the storage levels. This design reduces the path of the ammunition bodies from their storage space in the magazine to the ammunition elevator. The ammunition elevator can be arranged in the middle of the magazine, so that the two storage areas are of the same size and accordingly the same number of storage spaces is available on both sides of the ammunition elevator. The ammunition bodies of the two storage areas can be fed to the ammunition elevator independently of each other, which simplifies the selection of ammunition bodies, for example. The division of the magazine into two parts also makes it possible to directly select twice the number of different ammunition bodies. For example, if there are three storage levels, a different type of ammunition body may be present not only at each storage level, but also in each storage area of each storage level.

With regard to the magazine, it has proved to be advantageous if at least one conveying device is assigned to the storage levels for conveying the ammunition bodies in the respective storage level. By means of the conveying device, the ammunition bodies can be moved back and forth in the horizontal direction between the individual storage spaces of a storage level.

Furthermore, it has proved to be advantageous if the storage levels are designed as stack stores in which the ammunition bodies are stored according to the last-in-first-out principle. Such a stacking structure can be characterized by a small installation space, since no space is needed to move the ammunition bodies past each other. Furthermore, only a single or at least one storage level may be provided, which is designed as stack storage and in which the ammunition bodies are stored accordingly.

During ammunition loading, the ammunition bodies can first be moved through the ammunition elevator to the appropriate storage level and then moved by the conveying device in a storage direction until they have reached their final storage space. During removal, the ammunition bodies are then conveyed by the conveying device in the opposite removal direction from their respective storage space to the ammunition elevator. When moving the ammunition bodies to or from their final storage space, the conveying device may move the ammunition bodies past multiple storage spaces, depending on how many ammunition bodies are already at the corresponding storage level.

If, for example, a storage level is still empty and is to be gradually filled with multiple ammunition bodies, the conveying device first transports the first ammunition body to the storage area that is furthest from the ammunition elevator. The ammunition body passes through the storage areas that lie between the ammunition elevator and the final storage area before arriving at it. During removal, the conveying device may move the ammunition bodies accordingly towards the ammunition elevator. Since all storage spaces of the storage level or the storage area of the storage level are passed through between the storage area of the ammunition body to be removed and the ammunition elevator, the ammunition body nearest to the ammunition elevator must always be removed first at each storage level.

In a design development, it has proved to be advantageous if at least one conveying device is provided between the storage levels. This design makes it possible to convey the ammunition bodies with the fewest possible conveying devices, which reduces the installation volume of the magazine. If three storage levels are provided, two conveying devices may be provided, one between the middle and lower storage levels and one between the middle and upper storage levels. In this respect, the conveying device may move both ammunition bodies that are arranged below the conveying device and ammunition bodies that are arranged above it. It is possible to move multiple ammunition bodies at the same time, even in different storage levels, with one conveying device. Nevertheless, each storage level may also have its own conveying device assigned to it, or some storage levels may have only one, and other storage levels may be assigned multiple conveying devices. Furthermore, conveying devices may also be provided which are arranged below or above a storage level, but not between two storage levels. For example, a conveying device may be arranged below the lowest storage level or above the highest storage level.

To drive the conveying device, it may be advantageous if each conveying device has a single level drive. Furthermore, it is also possible that only one drive is provided for all conveying devices or for all conveying devices in a storage area. The conveying devices can then be coupled to each other accordingly, for example via a belt drive.

With regard to the constructive design of the conveying device, it has proved to be advantageous if it has at least one rotatable conveying shaft for conveying the ammunition bodies. The conveying shaft may be arranged between two adjacent retaining apparatuses. With regard to the arrangement of the conveying device, between does not mean that the conveying shaft is precisely arranged between two retaining apparatuses, but above and between or below and between the retaining apparatuses. Ammunition bodies can be conveyed from a storage space to an adjacent storage space by means of the conveying shaft. The retaining apparatus can first be moved to a transfer position in which it is possible to insert ammunition bodies into the retaining apparatus or to remove them from the retaining apparatus. Subsequently, the ammunition bodies can then be conveyed by means of the rotatable conveying shaft from one retaining apparatus to the other retaining apparatus. The conveying shafts can extend parallel to the longitudinal axes of the ammunition bodies or the retaining apparatuses. Furthermore, a conveying shaft may also be arranged between the ammunition elevator and the first retaining apparatus. The design of the conveying devices may be independent of the positioning of the conveying devices.

The magazine may have two, in particular parallel, base plates, between which the conveying device or the conveying shafts are rotatably mounted. For storage, the base plates may have a hole pattern with multiple holes. The conveying shafts can be inserted into the corresponding holes. The base plates can be spaced apart from each other by multiple rods, in particular four. The retaining apparatuses or the retaining shells of the retaining apparatuses may be rotatably supported between the two base plates. The longitudinal axes or the rotation axes of the retaining apparatuses can be arranged parallel to each other, so that a matrix-like arrangement results. Furthermore, the longitudinal axes or the rotational axes of the retaining apparatuses may be arranged perpendicular to the base plates.

It may also be advantageous if the conveying shaft has at least one conveying wheel with at least one receiving contour for receiving an ammunition body. When conveying an ammunition body, it can be received in the receiving contour and then conveyed by the rotation of the conveying shaft. The receiving contour may be adapted to the ammunition body geometry for the safe transport of the ammunition bodies, so that the ammunition bodies cannot slip during conveying. It may be advantageous if the receiving contour is concave. In order to retain the ammunition bodies securely when conveying from one retaining apparatus to another retaining apparatus, it has proved to be particularly advantageous if each conveying shaft has two conveying wheels. For example, one conveying wheel can engage the rear of the ammunition body and one conveying wheel can engage the middle area of the ammunition body, which is usually the heaviest. An additional conveying wheel for the front part of the ammunition bodies is also possible. The transport wheels of a conveying shaft may be connected to each other by a strut and rotationally coupled to each other by the strut.

Furthermore, it may be advantageous if the conveying wheel is designed as a star wheel, in particular with four receiving contours. If the conveying wheel has four receiving contours, the conveying wheel may be rotated by a quarter of a rotation to convey an ammunition body. This has proved to be advantageous in practice. If multiple conveying wheels are provided, each conveying wheel can be designed as a star wheel.

In order to rotate the conveying shaft and thus also the conveying wheels, it has proved to be advantageous if the conveying shaft has a drive wheel. The drive wheel can be connected to the strut and can thus also be rotationally coupled to the conveying wheels. The drive wheel can be arranged at one end of the conveying shaft and driven by a chain or belt drive. Furthermore, it is also possible that the drive wheel is part of a drive motor, especially if each conveying shaft is driven by its own drive motor.

It has also proved to be advantageous if the conveying shafts of a conveying device can be rotated by means of a common level drive. By means of the common drive, all conveying shafts of a conveying device can thus be rotated synchronously and it is not necessary to drive all conveying shafts individually. The drive wheels of the conveying shafts can be coupled to each other, for example via a chain or a belt. Furthermore, it is possible that the drive shafts of different conveying devices are also coupled to each other, whereby the number of required drives can be reduced even further. Nevertheless, it has proved to be advantageous in terms of reliability if only the conveying shafts of a conveying device are coupled to each other. Alternatively, it is also possible to provide a separate drive for all conveying shafts.

If a conveying device is provided above a storage level and a conveying device is provided below a storage level, it may be necessary for the conveying shafts of the two conveying devices to rotate in different directions for conveying the ammunition bodies. If, for example, an ammunition body is to be moved in the storage direction, it may be necessary that the conveying shafts arranged above the corresponding storage level must be rotated clockwise and the conveying shafts arranged below the conveying shafts must be rotated counterclockwise, since the ammunition body is conveyed both from above and from below by the respective conveying wheels during conveying.

In a development, it may be provided that two conveying shafts which have a rotation angle offset relative to each other are provided between two adjacent retaining apparatuses. Each of these two conveying shafts may have one or more conveying wheels, so that the ammunition bodies can be transferred from the conveying wheels of one conveying shaft to the conveying wheels of the other conveying shaft when conveying from a retaining apparatus to an adjacent retaining apparatus. This allows better guidance of the ammunition bodies between two retaining apparatuses. This double guidance has proved to be particularly advantageous for storage levels with ammunition bodies which are conveyed only by conveying devices arranged above the storage level, for example for the lowest storage level. Furthermore, the ammunition bodies can also be conveyed by means of the double guidance over a greater distance between two adjacent retaining apparatuses. This can also be advantageous when conveying from the ammunition elevator to the first retaining apparatus closest to the ammunition elevator, since this distance may be greater than the distance between two retaining apparatuses of a storage level.

In an alternative embodiment, it may be provided that the conveying device has at least one, in particular three, rotatable screw rollers for conveying the ammunition bodies. Ammunition bodies can also be moved back and forth between two adjacent retaining apparatuses by means of a screw roller. The screw roller may have a corkscrew-like screw guide, which moves the ammunition bodies linearly in the storage direction or in the removal direction during a rotation. For safe conveying of the ammunition bodies, three screw rollers have proved to be advantageous, wherein one may be arranged in the front part, one in the middle part and one in the rear part of the ammunition body or the retaining apparatus.

It has further proved to be advantageous if the screw roller extends perpendicular to the longitudinal axis of the retaining apparatus. Due to this design, the ammunition bodies can already be conveyed in a storage level by means of just one screw roller. However, it may be advantageous if multiple, in particular three, screw rollers are provided, each of which is arranged in parallel and which extends perpendicular to the longitudinal axis of the retaining apparatus of the level. If the conveying device has a conveying shaft, the required number of conveying shafts depends on the number of retaining apparatuses. With regard to the retaining apparatus, the terms longitudinal axis and rotation axis are used synonymously.

The number of conveying shafts per level may correspond to the number of retaining apparatuses per level, since a respective conveying shaft may be arranged between the adjacent retaining apparatuses of a level and additionally between the ammunition elevator and the first retaining apparatus. The screw rollers, on the other hand, cannot be coupled to the number of retaining apparatuses. This is because the number of retaining apparatuses provided only has an influence on the length of the screw rollers, but not on the number. In this respect, the number of screw rollers can be independent of the number of retaining apparatuses.

From a design point of view, it has also proved to be advantageous if the screw roller has a constriction for the retaining apparatus. The constriction allows the vertical distance of the screw roller and the ammunition bodies retained in the retaining apparatus to be reduced, which allows reliable conveying. Due to the constriction, the screw roller can rotate and the retaining apparatus cannot prevent a corresponding rotation. It may be advantageous if the screw roller has a constriction for each retaining apparatus of the respective storage level. The constriction and the screw guide may be arranged alternately one after the other, so that a constriction is provided in the region of the retaining apparatuses and a screw guide is provided between the retaining apparatuses for conveying the ammunition bodies.

The screw rollers may each have a drive wheel by means of which the screw rollers can be rotated to convey the ammunition bodies. It may be advantageous if the screw rollers of a—conveying device are driven by a level drive, so that the screw rollers of a conveying device rotate synchronously. The drive wheels of the individual screw rollers can, for example, be coupled to each other or to the level drive via chains or belts for this purpose. Analogous to the drive of the conveying shafts, only one drive per conveying device must therefore be provided.

In a development, it is proposed that the magazine has guide rails for guiding the ammunition bodies from the retaining apparatus to the conveying device. By means of the guide rails, reliable transfer of the ammunition bodies from a retaining apparatus to the conveying device and vice versa can be ensured. The guide rails can be arranged above and below each storage level, so that the ammunition bodies are each guided between two guide rails. The conveying wheels, in particular the conveying wheels engaging the ammunition bodies in the middle, may be designed as double wheels and may engage around the guide rails from both sides. The guide rail may have a bore through which the struts of the conveying unit can extend for this purpose. The guide rail can be designed as a sliding rail and can be made of a slidable material.

In order to convey the ammunition bodies out of the magazine, it has proved to be advantageous if a push-out device, for example in the form of a thrust element, a rigid backed chain or a driving element is provided. The push-out device can be used to push an ammunition body out of the ammunition elevator in the removal position, for example towards the vehicle interior.

Furthermore, a vehicle, in particular a military land vehicle, with a magazine of the type described above is proposed. This can result in the advantages already described with regard to the magazine.

The vehicle may have a vehicle hull and a turret rotatable relative to the hull. The turret may have a large-caliber weapon with which the ammunition bodies can be fired. The magazine can be arranged in the vehicle hull or in the turret.

In the ammunition body removal direction, a removal space may be arranged behind the magazine, which is required for the removal of the ammunition bodies from the magazine or for pushing the ammunition bodies out of the magazine. Since the ammunition bodies, in particular all the ammunition bodies in the magazine can only be removed or pushed out in a single predefined removal position, the removal space is smaller than the magazine and this can be about the size of an ammunition body. In this respect, a free space which is not required for the removal of the ammunition bodies may be provided in addition to the removal space. The free space can extend around the removal space and to the walls of the hull or turret. The free space can be located above and below as well as to the left and right of the removal space or the ammunition body. Since the free space is not needed for the removal of the ammunition body, this region can be used in another way, for example for the storage of equipment. This design also represents, for example, a significant difference from rack magazines, in which a removal space must be kept in front of the entire magazine for the removal of the ammunition bodies and thus a separate removal position is provided for each ammunition body.

Furthermore, a method for storing ammunition bodies in a magazine is proposed, which allows fast access times even with different types of ammunition.

The method can be characterized in that the ammunition bodies are conveyed by a conveying device from a retaining apparatus to an adjacent retaining apparatus. Due to this method, individual ammunition bodies are moved back and forth between the various storage spaces independently of the other ammunition bodies. It is not necessary to move all ammunition bodies and retaining apparatuses together, but an ammunition body is selected and then conveyed independently of the other ammunition bodies from a retaining apparatus to an adjacent retaining apparatus. To store the ammunition bodies in the magazine, they are moved in a storage direction from retaining apparatus to retaining apparatus until they have reached their final position in the magazine. The final position or the final storage space corresponds to the storage space where the ammunition body remains for a longer period of time after storage and which is not just passed through. In order to remove the ammunition bodies from the magazine, they are moved in the opposite removal direction to the ammunition elevator. This then transfers the ammunition bodies to a removal position in which the ammunition bodies can be removed from the magazine.

It may be advantageous if the magazine for the method is designed in the manner described above. The advantages already described with regard to the magazine may result.

Furthermore, with regard to the above-mentioned problem, an ammunition elevator is proposed with a retaining apparatus which is designed in the manner described above. The advantages already described with regard to the retaining apparatus can result. The ammunition elevator can be part of the magazine described above.

Furthermore, it may be advantageous if the ammunition elevator is designed in the manner described below.

For the vertical movement of ammunition bodies between two storage levels of a magazine, the ammunition elevator may have a receiving shell for receiving an ammunition body and a retaining apparatus for retaining the ammunition body, wherein the retaining apparatus can raise the ammunition body vertically from the receiving shell.

Due to the raising of the ammunition body, it is not necessary that it must be ejected laterally from the receiving shell, but the ammunition body can be pushed onto the receiving shell and then grabbed by the retaining apparatus, for which the retaining apparatus can be transferred from a grabbing position to a retaining position. Subsequently, the retaining apparatus can then be raised vertically together with the ammunition body and then moved to a transfer position in which the ammunition body can be ejected from the retaining apparatus and fed to the appropriate storage level.

With regard to the receiving shell, it has proved to be advantageous if the ammunition bodies can be pushed onto the receiving shell in the longitudinal direction. The receiving shell can be open at the front and rear ends, so that ammunition bodies can be pushed from behind onto the receiving shell and pushed forward out of the receiving shell. In this respect, the receiving shell can serve as a linear guide for the ammunition bodies so that they are retained securely in the receiving shell and cannot be pushed out of the side of the receiving shell. The receiving shell can be of a cylindrical segment form and the inner diameter of the receiving shell can be adapted to the largest diameter of the ammunition body. As a rule, this will be the diameter at the lower end of the ammunition body. This allows the ammunition bodies to be safely guided in the receiving shell. The longitudinal axis of the ammunition body, if it is lying on the receiving shell, corresponds to the longitudinal axis or the cylinder axis of the receiving shell.

The receiving shell can be longer than the ammunition bodies, so that they do not protrude from the receiving shell. The receiving shell may have substantially the same length as the retaining apparatus or as the retaining shells of the retaining apparatus.

It has also proved to be advantageous if the retaining apparatus and the receiving shell are arranged parallel to each other. This design ensures that an ammunition body located on the receiving shell can be reliably grabbed and lifted away by the retaining apparatus. The ammunition body does not have to be rotated or swiveled. At the same time, it is also ensured that the ammunition body can be placed on the receiving shell in order to be able to move, for example, into a removal position in which the ammunition body can be pushed out of the magazine. The retaining apparatus may have a rotation axis and the rotation axis may be parallel to the longitudinal axis of the receiving shell.

In a development, it is also proposed that the retaining apparatus is movable in a vertical direction relative to the receiving shell. This design makes it possible that the distance of the retaining apparatus from the receiving shell is not constant, but the retaining apparatus can move towards the receiving shell, for example to pick up and lift an ammunition body from the receiving shell.

To this end, it is further proposed that the retaining apparatus can lift the ammunition bodies as a type of grabber from the receiving shell and can place them on the receiving shell. Due to the grabber-like design, the retaining apparatus can lift an ammunition body upwards out of or from the receiving shell and it is not necessary that the ammunition body can also be pushed onto the retaining apparatus. The actual movement of the ammunition bodies between the storage levels can thus be undertaken by the retaining apparatus and the receiving shell allows the ammunition bodies to be inserted into the ammunition elevator.

From a design viewpoint, it has proved to be advantageous if the receiving shell has a recess, in particular two recesses. One, in particular two, projectile supports may be provided, which may, for example, be arranged on the floor of the ammunition elevator or the magazine. If the receiving shell is located in the lowest storage level, the projectile support can extend through the recesses and hold part of the ammunition body. The design and position of the projectile support can be adapted to the contour of the ammunition body. This is because this is usually narrower in the front region than in the rear region, so that the projectile support can support the ammunition body, especially in the front region. In this respect, the projectile support can also ensure that the retaining apparatus can reliably grab the ammunition bodies and then lift them from the receiving shell.

It has proved to be advantageous for movement of the retaining apparatus if it can be moved in a vertical direction by means of a linear drive. By means of the linear drive, the retaining apparatus can be moved up and down and moved to any storage level. The linear drive enables precise position control of the retaining apparatus, so that the ammunition bodies can be reliably lifted from or placed on the receiving shell and the various storage levels can be approached precisely.

Furthermore, it has proved to be advantageous if two linear drives are provided, wherein the one linear drive may be arranged on one side of the retaining apparatus and the other linear drive on the other side of the retaining apparatus. These two linear drives ensure that the retaining apparatus remains as straight as possible during a vertical movement, so that the ammunition body cannot move unintentionally due to an inclination. Furthermore, the weight of the ammunition body located in the retaining apparatus can be evenly distributed by two linear drives. It may be advantageous if one linear drive is arranged in one end region of the retaining apparatus and the other linear drive is arranged in the other end region. The retaining apparatus can then extend between the two linear drives.

With regard to the design of the linear drive, it has proved to be advantageous if this has at least one, in particular two, rotatable threaded spindles, which move the retaining apparatus in a vertical direction during a rotation. Due to the use of a threaded spindle, the position of the retaining apparatus can be controlled very precisely. The movement of the retaining apparatus can be dependent on the direction of rotation of the threaded spindle, for example the retaining shell can be moved upwards when the threaded spindle is rotated clockwise, and downwards when the threaded spindle is rotated counterclockwise. Two threaded spindles allow the acting forces to be evenly distributed, which improves the overall stability of the ammunition elevator. It may be advantageous if the threaded spindles are arranged parallel to each other and extend perpendicular to the longitudinal axis of the ammunition body or perpendicular to the retaining apparatus. Furthermore, it may be advantageous if both linear drives each have two threaded spindles, so that the retaining apparatus can be moved up and down by four threaded spindles in total. This ensures particularly uniform support of the retaining apparatus.

The threaded spindles of a linear guide can be rotatably supported at the lower end in a bearing rail, so that they do not shift, but retain a firmly defined position even during a rotation. Also, at the upper end of the threaded spindles, where the lifting motor and the gearbox can be arranged, the two threaded spindles can be connected to each other via a corresponding bearing rail. The linear drive can then have a rectangular shape.

In a development, it is proposed that the linear drive has a guide element, which is arranged as a type of spindle nut on the threaded spindle. By rotating the threaded spindle, the guide element can be moved up and down. The guide element may be connected to the retaining apparatus, in particular the retaining apparatus is rotatably mounted in or on the guide element. The guide element can be arranged on both threaded spindles of a linear drive and can connect the two threaded spindles to each other in this respect. The guide element may have two threaded holes through which the two threaded spindles can extend, wherein the threads can mesh together in such a way that the guide element can be moved in a vertical direction. It may be advantageous if two guide elements are provided, one for each linear drive. The retaining apparatus can then be rotatably supported on both sides in or on a guide element.

To turn the threaded spindle it has proved to be advantageous if a lifting motor is provided, which can drive the threaded spindle, in particular both threaded spindles of a linear drive, via a gearbox. The lifting motor may be located at the upper end of the linear drive so that it does not obstruct the movement of the retaining apparatus. The lifting motor can be connected via a gearbox to both threaded spindles of a linear drive, so that the two threaded spindles always rotate synchronously. This prevents the guide element from tilting due to uneven rotation of the threaded spindles. With two linear drives, a separate lifting motor may be provided for each linear drive. Both lifting motors can be coupled to each other, in particular via a corresponding controller, so that all four threaded spindles rotate synchronously.

According to an advantageous development, it is provided that the receiving shell is movable in a vertical direction. By moving the receiving shells, ammunition bodies can be pushed onto the receiving shell at different levels and pushed out of the receiving shell at different levels. For example, it may be desirable to load ammunition in the ammunition depot at the lowest level and to remove the ammunition bodies at a higher level. The receiving shell can then be moved to the desired ammunition position and the ammunition bodies can then be lifted off the receiving shell by means of the retaining apparatus and then stored. If an ammunition body is to be removed from the magazine, it can be placed on the receiving shell by the retaining apparatus. In a next step, the receiving shell can then be moved to the removal position and the ammunition body can be pushed out at the desired location. The movement of the receiving shell thus allows variable loading of ammunition and removal of ammunition bodies at different levels. In this respect, the ammunition elevator can therefore also be used for existing magazines and vehicles and can also serve as a retrofit solution.

With regard to the relative movement of the receiving shell and the retaining apparatus, it has proved to be advantageous if the receiving shell and the retaining apparatus are coupled to each other in such a way that the receiving shell can be moved together with the retaining apparatus if the retaining apparatus is at or above a limit level. It may be advantageous if the limit level is the second storage level. The storage levels are counted from below, with the lowest level corresponding to the first level. If, for example, the retaining apparatus is moved upwards and exceeds the limit level, the receiving shell is moved accordingly. The retaining apparatus and the receiving shell are then coupled and they move simultaneously by the same distance in the vertical direction.

Furthermore, it has proved to be advantageous if the receiving shell is decoupled from the retaining apparatus when the retaining apparatus is below the limit level. In order to pick up an ammunition body from the receiving shell or to place an ammunition body from the retaining apparatus onto the receiving shell, both the receiving device and the retaining apparatus can be moved to the lowest storage level. To achieve this, the retaining apparatus below the limit level can be moved independently of the receiving shell. The receiving shell may be located at the lowest level if the retaining apparatus is at the limit level.

If the retaining apparatus is located at or above the limit level, the receiving shell may be located below the retaining apparatus by the distance of the limit level from the lowest level. If, accordingly, the second storage level is the limit level, the distance of the receiving shell from the retaining apparatus is then the distance of the limit level from the lowest storage level.

From a design viewpoint, it may be advantageous if the receiving shell is coupled to the retaining apparatus by a linear guide. Due to the linear guide, the receiving shell can be moved vertically together with the retaining shell by means of the linear drive. The receiving shell does not require its own drive, but this is moved by means of the lifting motor or the lifting motors of the linear drives. The linear guide can be designed as a vertical strut that can extend parallel to the threaded spindle. It may be advantageous if two, in particular four, linear guides are provided so that the receiving shell can be safely moved in the vertical direction, even if an ammunition body is resting on it. Each two of the four linear guides can be connected to an end region of the receiving shell. Furthermore, it is possible that two linear guides are connected to each other, in particular via a U-shaped connection. Due to this design, the receiving shell can rest on the connection of the two linear guides, which increases stability. Furthermore, it may be advantageous if the linear guide is guided in the guide element.

In the case of a relative movement of the retaining apparatus in relation to the receiving shell, the guide element can slide over the linear guide so that the receiving shell is not moved with it.

In a development of the linear guide, it is proposed that this has a stop that limits a movement of the retaining apparatus relative to the receiving shell. The stop can be arranged at the upper end of the linear guide and ensure that the guide element moves the mounting shell with it. In the case of a vertical movement upwards, the guide element can hit the stop, so that in the event of a further movement, the receiving shell is moved together with the guide element or the retaining apparatus. The stop can hit the guide element if the retaining apparatus is at the limit level.

The distance of the stop from the receiving shell or the length of the linear guide may be such that the distance between the receiving shell and the retaining apparatus corresponds to the distance of the lowest storage level from the limit level. If, for example, the second level is the limit level, the length of the linear guide can such that the distance between the retaining apparatus and the receiving shell corresponds to a storage level.

Furthermore, it is proposed that the receiving shell is suspended from the retaining apparatus so as to be movable linearly. The receiving shell may be suspended from the retaining apparatus by means of the guide element. Although the linear guide may consist of rigid struts, these can basically act like ropes. This is because if the receiving shells have not yet reached the lowest storage level, the receiving shell can move in parallel with the retaining apparatus. If the retaining apparatus reaches the limit level and the receiving shell reaches the lowest storage level, the retaining apparatus can be moved further downwards and can then, lift an ammunition body from the receiving shell, for example.

With regard to the retaining apparatus, it has proved to be advantageous if it has two retaining shells, which are connected to each other at one end by a gearbox and at the other end by a rotary bearing. The rotary bearing can be mounted in a guide element or the rotary bearing can be part of the guide element, so that the two retaining shells can be rotatable relative to the guide element. The opposite sides of the retaining shells can be mounted in another guide element, so that the retaining apparatus is then arranged between the two guide elements and is rotatable relative to them.

With regard to the retaining apparatus, it has proved to be advantageous if it can be moved into a retaining position, a transfer position and a grabbing position. In the retaining position, an ammunition body can be secured in the retaining apparatus and moved in a vertical direction together with the retaining apparatus. In the grabbing position, the retaining apparatus can be moved from above to an ammunition body located on the receiving shell, so that the retaining apparatus grabs the ammunition body at least partly. If the retaining apparatus is then moved to the retaining position, the ammunition body is secured in the retaining apparatus and can then be lifted off the receiving shell. In the transfer position, an ammunition body can be ejected from the retaining apparatus, especially laterally, and then fed to a retaining place of a magazine, for example.

BRIEF DESCRIPTION OF DRAWINGS

Further advantages and details of the magazine and the method will be explained in more detail below with the help of the attached figures using exemplary embodiments. In the figures.

and

Figure 19A:
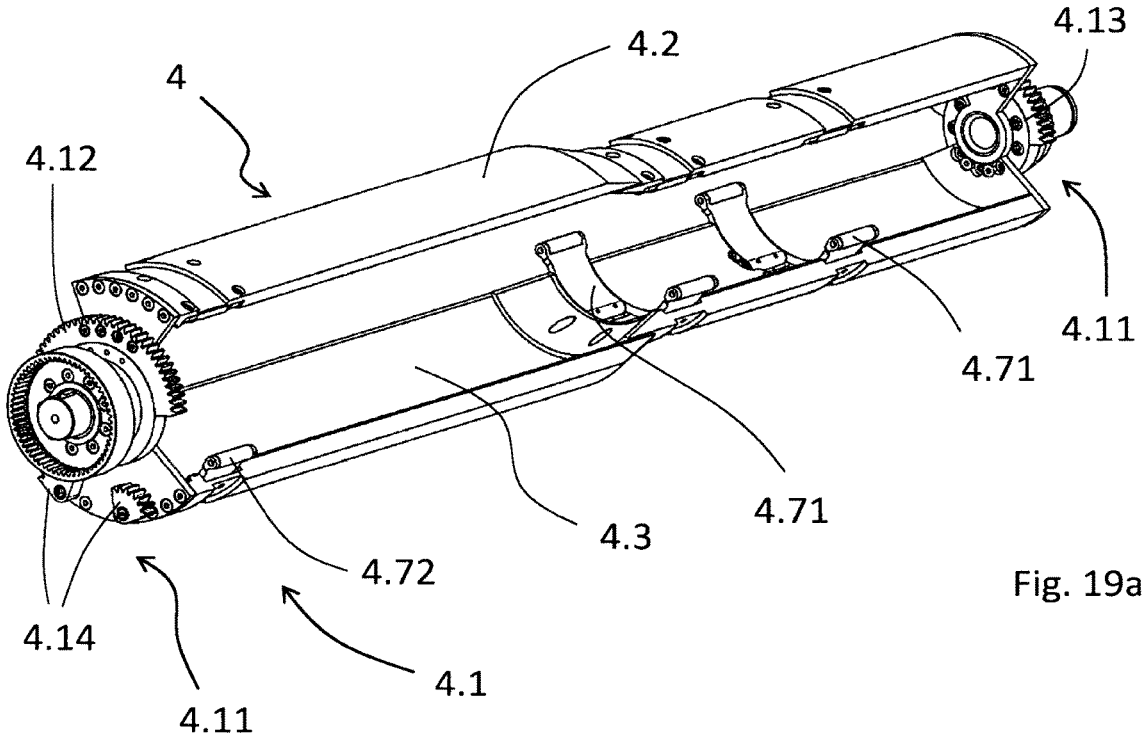
FIG. 19*a* shows a perspective view of the retaining apparatus and the ejection mechanism.
Figure 19B:
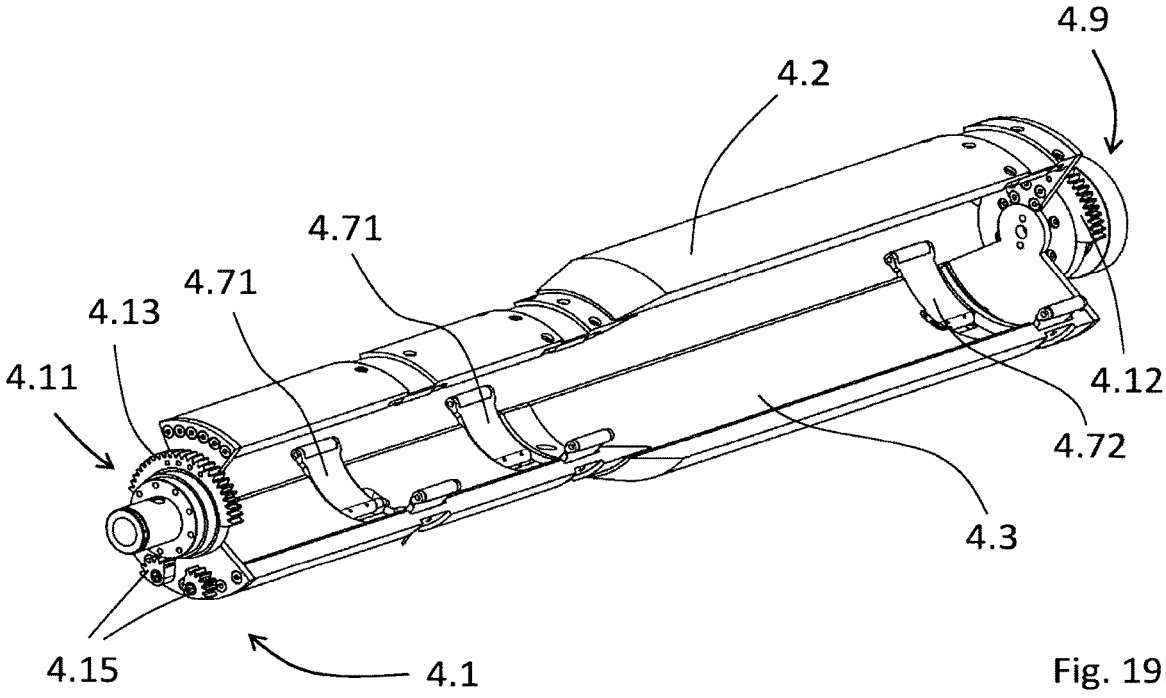

FIG. 19*b* shows a perspective view of the retaining apparatus and the ejection mechanism.

DETAILED DESCRIPTION

The design of the magazine 1 as well as loading ammunition into the magazine 1 and the removal of ammunition bodies 100 from the magazine 1 will be described below in more detail, before the design of the retaining apparatus 4 and the design of the ammunition elevator 7 are discussed in more detail.

Figure 1:
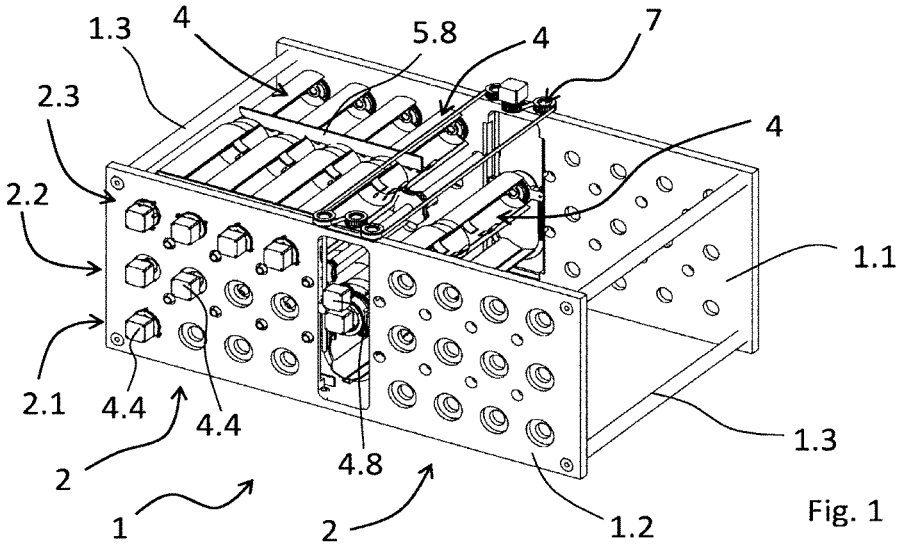
FIG. 1 shows a magazine in a perspective side view.

The magazine 1 shown in FIG. 1 is used for the horizontal storage of ammunition bodies 100, in particular in the form of 120 mm cartridges, and can be used, for example, in a military vehicle 200. As will be described in more detail below, the magazine 1 can, for example, be equipped with ammunition bodies 100 before an operation, and during an operation the individual ammunition bodies 100 can first be moved to a removal position P, removed from the magazine 1 one after the other, fed to the weapon 203 of the vehicle 200 and then fired.

The magazine 1 has a total of 24 storage spaces 3 for the storage of ammunition bodies 1, wherein an ammunition body 100 can be stored in each storage space 3. Furthermore, an ammunition body 100 can also be accommodated in the ammunition elevator 7, so that the magazine 1 has a total capacity of 25 ammunition bodies 100. Each storage space 3 is assigned a retaining apparatus 4, so that the individual ammunition bodies 100 are retained securely in each storage space 3 and cannot slip.

As can also be seen in the illustration of FIG. 1, the magazine 1 has two base plates 1.1, 1.2 arranged parallel to each other, which are arranged spaced apart from each other by means of multiple rods 1.3. The base plates 1.1, 1.2 each have a hole pattern 1.4, so that the retaining apparatus 4 can be mounted between the two base plates 1.1, 1.2.

An ammunition elevator 7, which divides the magazine 1 into two different storage areas 2, is arranged in the middle of the magazine 1. For the sake of better clarity, in FIG. 1 the right storage area 2 is not equipped with retaining apparatus 4, so that the hole pattern 1.4 of the base plates 1.1, 1.2 can be seen. In the left storage area 2, the retaining apparatus 4 are also partially not shown, as can also be seen in FIG. 2. In this illustration, only the right storage area 2 and the ammunition elevator 7 can be seen and the front base plate 1.2 is not shown.

Furthermore, it can be seen that the individual storage spaces 3 are arranged in three storage levels 2.1, 2.2, 2.3 arranged one above the other. The storage levels 2.1, 2.2, 2.3 of each storage area 2 have four storage spaces 3 arranged next to each other and therefore also four retaining apparatuses 4 arranged next to each other. The storage spaces 3 of the different storage levels 2.1, 2.2, 2.3 are arranged one above the other in such a way that a matrix-like arrangement of the retaining apparatuses and the ammunition bodies 100 results.

In order to load ammunition into the magazine 100 and to populate it with a number of ammunition bodies 100, the ammunition bodies 100 are inserted one after the other into the ammunition elevator 7. Depending on the storage level 2.1, 2.2, 2.3 in which the respective ammunition body 100 is to be stored, the ammunition body 100 is then moved by the ammunition elevator 7 to the correct storage level 2.1, 2.2, 2.3. In a next step, the ammunition body 100 is then conveyed from the ammunition elevator 7 to the first storage space 3 of the corresponding storage level 2.1, 2.2, 2.3 and then moved in the storage direction E until the ammunition body 100 has reached its final storage space 3. Conveying the ammunition bodies 100 from the ammunition elevator 7 to the first storage space 3 and then to the other storage spaces 3 will be explained in more detail below.

If the magazine 1 is still empty, the first ammunition body 100, after it has been conveyed from the ammunition elevator 7 to the first storage space 3 of the corresponding storage level 2.1, 2.2, 2.3, continues to move three storage spaces 3 in the storage direction E until it has reached the outermost storage space 3. During this conveying, the ammunition body 3 thus passes through all the storage spaces 3 of the respective storage level 2.1, 2.2, 2.3 between the ammunition elevator 7 and the final storage space 3 of the respective storage level 2.1, 2.2, 2.3 of one of the two ammunition areas 2.

The next ammunition body 100 must then be conveyed from the first storage space 3 of the corresponding storage level 2.1, 2.2, 2.3 only by two storage spaces 3 until it has reached its final storage space 3. The further storage spaces 3 of the magazine 1 are then filled in an analogous manner.

When the ammunition bodies 100 are removed, they are moved in the removal direction A from their respective storage space 3 to the ammunition elevator 7. Since the ammunition bodies 100 must always pass through all storage spaces 3 which lie between their final or their current storage space 3 and the ammunition elevator 7, it is always only possible to convey to the ammunition elevator 7 the ammunition body 3 of a storage level 2.1, 2.2, 2.3 which is closest to the ammunition elevator 7. Each storage level 2.1, 2.2, 2.3 or each storage level 2.1, 2.2, 2.3 of the respective storage area 2 thus acts as stack storage and the ammunition bodies 100 can be taken from this stack storage according to the last-in-first-out principle. Although the order of removal of the ammunition bodies 100 of a storage level 2.1, 2.2, 2.3 is thus predetermined, a selection can be made between the different storage levels 2.1, 2.2, 2.3 and the different storage areas 2 during the removal.

If, for example, all storage spaces 3 of the magazine are occupied by an ammunition body 100, then when removing an ammunition body 100 a selection can be made from six different ammunition bodies 100, namely from the ammunition bodies 100 of the respective levels closest to the ammunition elevator 7. In this respect, it is also possible that different types of ammunition are stored in the different storage levels 2.1, 2.2, 2.3 and/or in the two storage areas 2 and then a certain type of ammunition body is selected and removed during the removal depending on the requirements.

A conveying device 5 is provided for conveying ammunition bodies 100 from the ammunition elevator 7 to the first storage space 3 and for moving the ammunition bodies 100 between the individual storage spaces 3 or the individual retaining apparatuses 4. The conveying device 5 is provided between the individual storage levels 2.1, 2.2, 2.3, so that at least two conveying devices 5 are provided on each storage side 2.

In one design, the conveying devices 5 have multiple conveying shafts 5.1, which are rotatably mounted between the two base plates 1.1, 1.2 of the magazine. These conveying shafts 5.1 can be seen, for example, in FIG. 5. The conveying shafts 5.1 extend parallel to the horizontal ammunition bodies 100 and each have multiple conveying wheels 5.2, 5.3 designed as radial wheels, which ensure during rotation that the ammunition bodies 100 are conveyed from a storage space 3 to an adjacent storage space 3.

Figure 5:
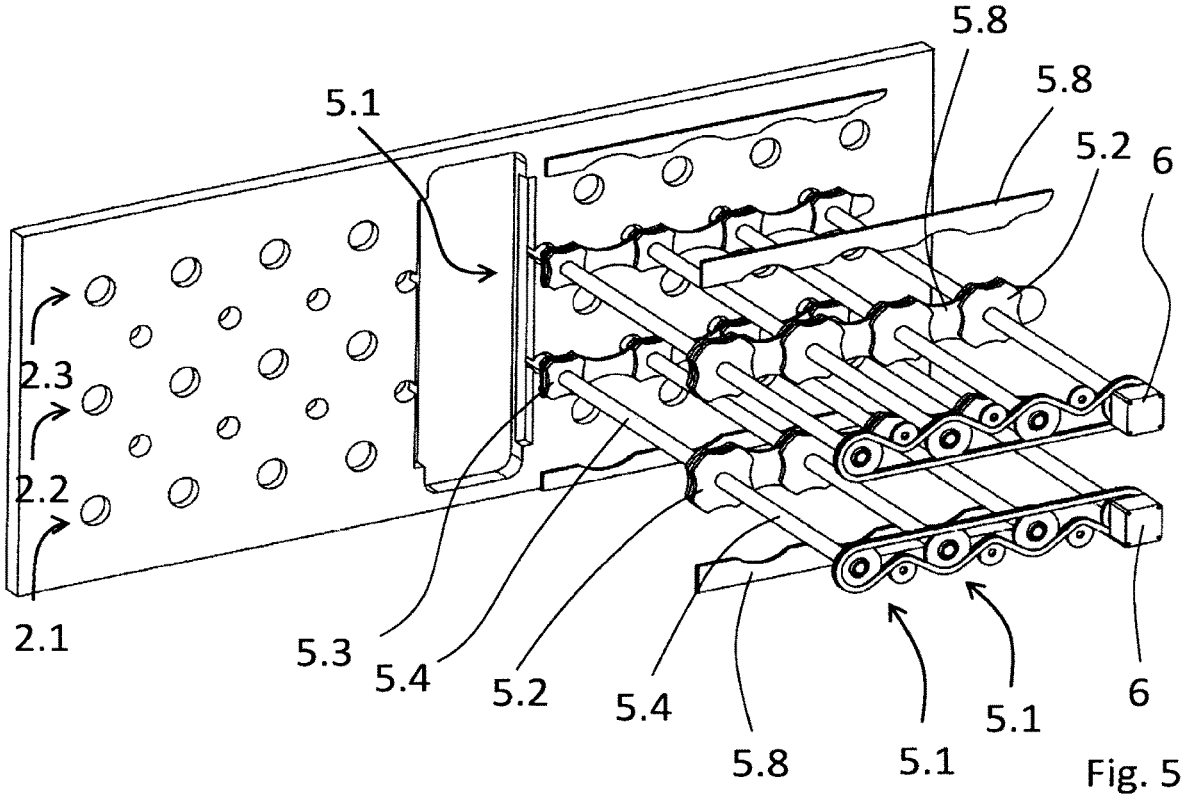
FIG. 5 shows the magazine according to FIG. 4 in a perspective side view.
Figure 10:
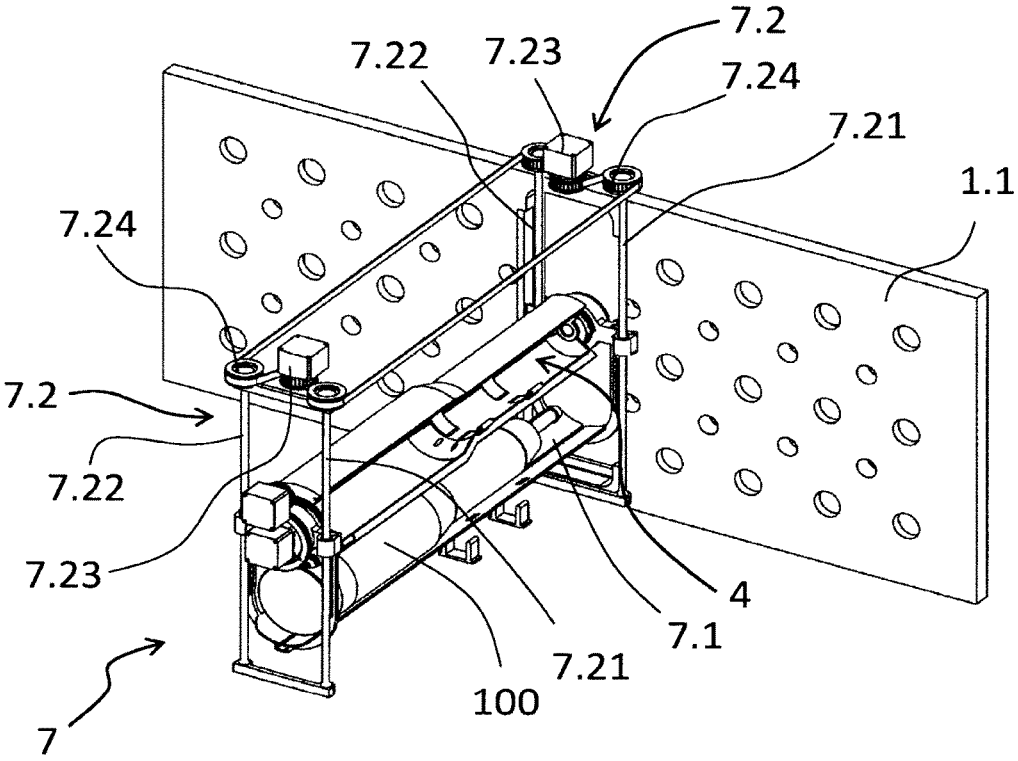
FIG. 10 shows a perspective side view of the ammunition elevator of the magazine.

In the design according to FIG. 5, the conveying shafts 5.1 each have two conveying wheels 5.2, 5.3, wherein the first conveying wheel 5.2 is larger than the second conveying wheel 5.3, which is related to the contour of the ammunition bodies 100. This is because the ammunition bodies 100 have a larger diameter in the rear region than in the middle region, which can also be seen, for example, in FIG. 10. The two conveying wheels 5.2, 5.3 are attached to or on a strut 5.4, so that when the strut 5.4 rotates, the two conveying wheels 5.2, 5.3 rotate in unison.

In order to convey the ammunition bodies from one storage space 3 to the next, the ammunition bodies 100 are first moved from the retaining apparatus 4 to the conveying wheels 5.2, 5.3. Starting from the position in FIG. 5, the conveying shafts 5.1 are first rotated by about 45 degrees towards the ammunition body 100 to be moved. In a next step, the retaining apparatus 4 is then transferred to a transfer position Ü, which allows the removal of the ammunition body 100. The different positions of the retaining apparatus 4 are described in more detail below with regard to the other figures.

If the ammunition body 100 is then resting on the conveying shaft 5.1 or on the conveying wheels 5.2, 5.3, the conveying shaft 5.1 is rotated by about 90 degrees towards the adjacent retaining apparatus 4 and can then be picked up by the corresponding retaining apparatus 4. In order to convey the ammunition body beyond that, the process is continued accordingly and the ammunition body 100 is passed to the next conveying shaft 5.1.

Figure 3:
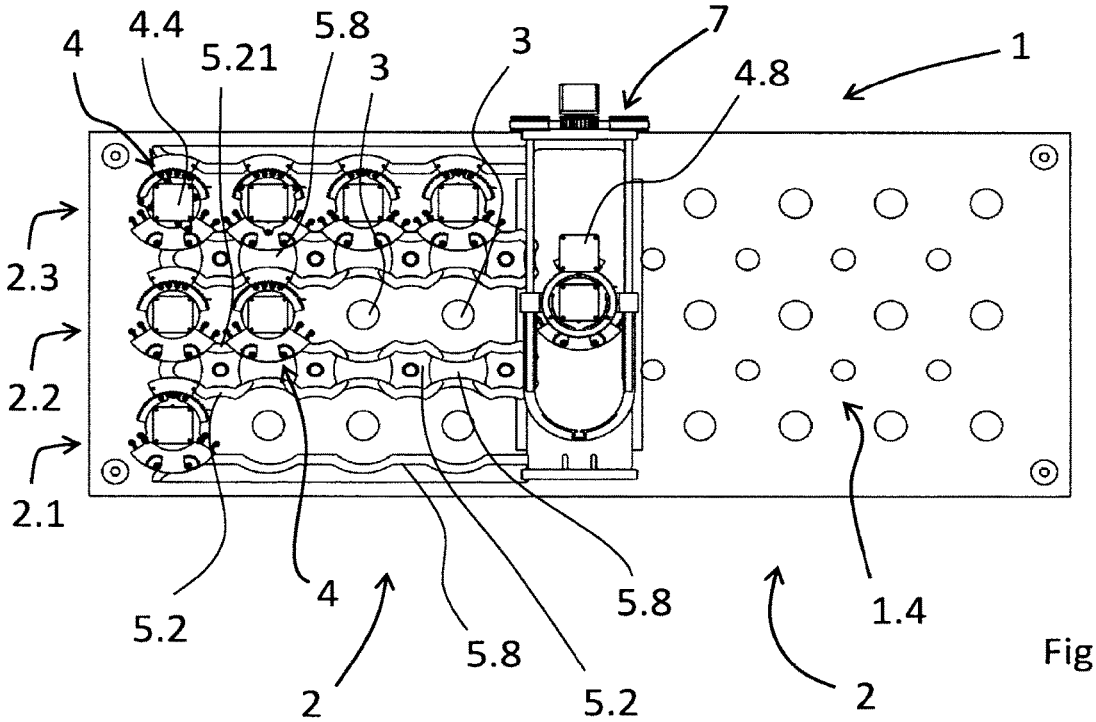
FIG. 3 shows a sectional view through the magazine according to FIG. 1.

In order to transfer the ammunition bodies 100 in this way from retaining apparatus 4 to retaining apparatus 4, the corresponding conveying shafts 5.1 are arranged above or below the retaining apparatus 4 and between two adjacent retaining apparatuses 4, as can be seen in FIG. 3, for example. Furthermore, it can be seen in FIG. 3 that conveying devices 5 are provided only between the storage levels 2.1, 2.2, 2.3. The lower conveying device 5 is thus responsible both for conveying the ammunition bodies 100 in the lowest storage level 2.1 and in the middle storage level 2.2. If, for example, an ammunition body 100 in the lowest storage level 2.1 according to the representation in FIG. 3 is to be moved in the storage direction E, i.e. from right to left, the conveying shafts 5.1 above the lower storage level 2.1 must rotate clockwise. If the same conveying shafts 5.1 are to move the ammunition bodies 100 of the middle storage level 2.2 correspondingly, the conveying shafts 5.1 must be rotated counterclockwise.

Since a conveying device 5 is provided both below and above the middle storage level 2.2, the ammunition bodies 100 of the middle storage level 2.2 are conveyed by both conveying devices 5. According to the illustration of FIG. 3, in order to move the ammunition bodies 100 in the storage direction E, the conveying shafts 5.1 arranged above the middle storage level 2.2 must then rotate clockwise and the conveying shafts 5.1 arranged below the middle storage level 2.2 must rotate counterclockwise. As can also be seen in FIG. 3, a conveying shaft 5.1 is also arranged between the first retaining apparatus 4 and the ammunition elevator 7, so that the ammunition bodies 100 can be moved both from the ammunition elevator 7 and to the ammunition elevator 7.

The number of conveying shafts 5.1 per conveying device 5 thus corresponds to the number of retaining apparatuses 4 or the number of storage spaces 3 per storage level 2.1, 2.2, 2.3 of each storage area 2. As can be seen in FIG. 3, four conveying shafts 5.1 per conveying device 5 are therefore also provided for the four retaining apparatuses 4.

Figure 6:
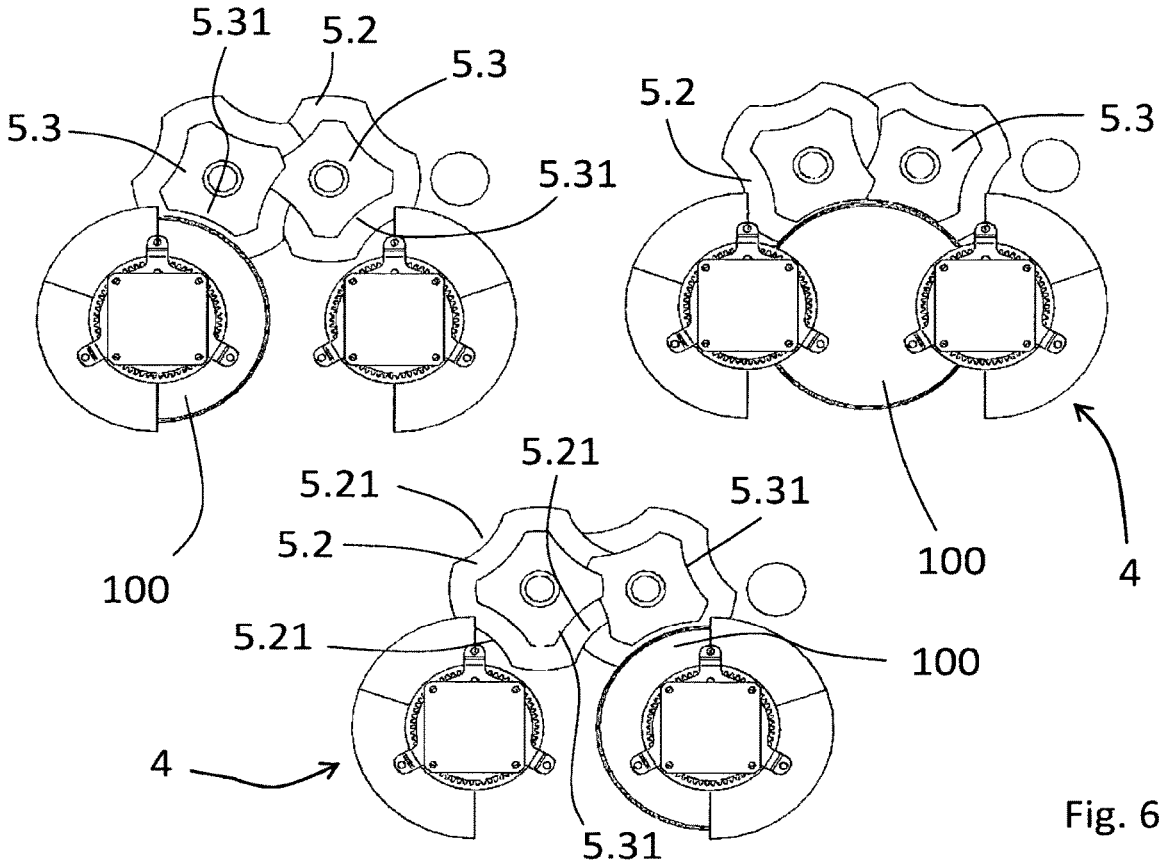
FIG. 6 shows different views of conveying an ammunition body from one retaining apparatus to an adjacent retaining apparatus.

The more precise design of the conveying wheels 5 can be seen in FIG. 5 and FIG. 6. Each conveying wheel 5.2, 5.3 has four concave receiving contours 5.21, 5.31, each offset by 90 degrees from each other. The curvature or the design of the receiving contours 5.21, 5.31 is adapted to the ammunition bodies 100, so that they lie as safely as possible in the corresponding receiving contours 5.21, 5.31 during conveying.

Furthermore, an alternative design is shown in FIG. 6, in which two conveying shafts 5.1 are provided between the retaining apparatuses 4 for conveying ammunition bodies 100 from one retaining apparatus 4 to an adjacent retaining apparatus 4. With this design, a conveying device 5 thus has twice as many conveying shafts 5.1 as retaining apparatuses 4 are provided in a storage level 2.1, 2.2, 2.3. As can also be seen in FIG. 6, due to twice the number of conveying shafts 5.1, the ammunition bodies 100 are better guided and transferred from one conveying shaft 5.1 to the other conveying shaft 5.1 and at about half the distance between the two retaining apparatuses 4.

Figure 7:
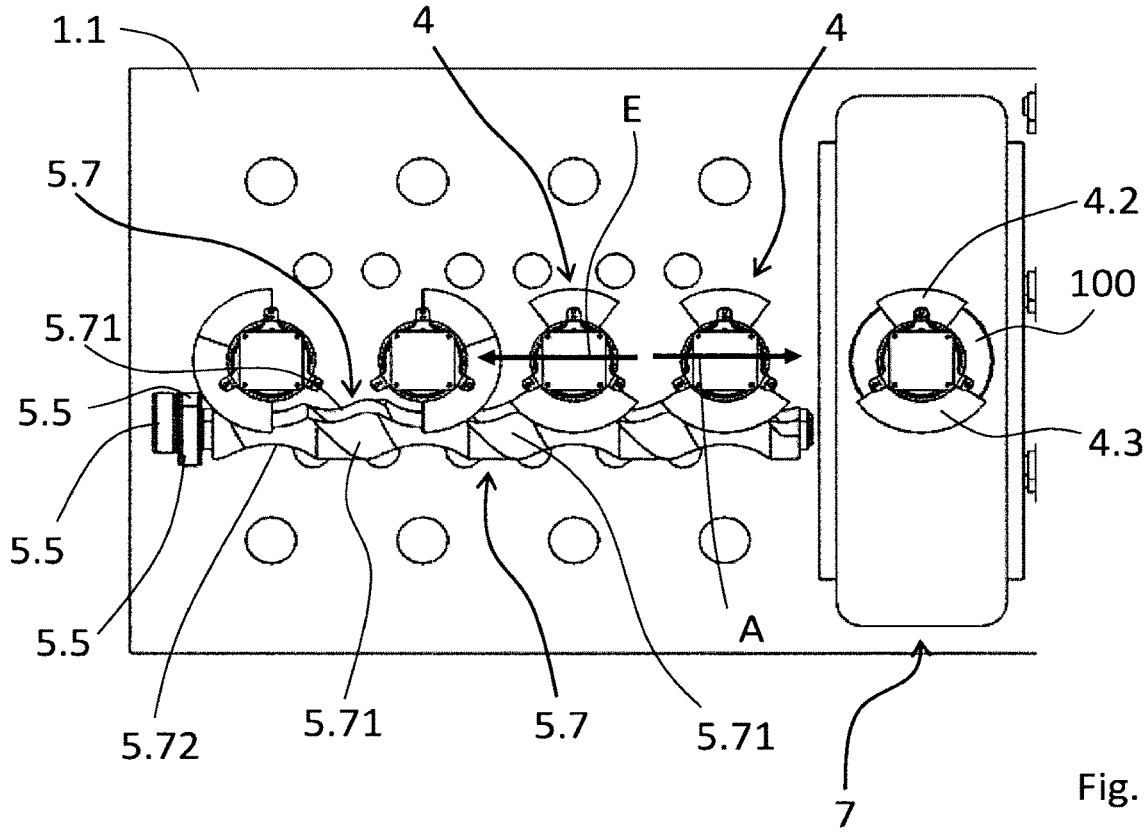
FIG. 7 shows a sectional view through a magazine in a further design.

If two conveying shafts 5.1 are used between two retaining apparatuses 4, it is accordingly necessary to adapt the hole pattern 1.4 in the base plates 1.1, 1.2. This becomes clear when comparing the hole patterns 1.4 of FIG. 5 and FIG. 7. Although no embodiment with two conveying shafts 5.1 between two retaining apparatuses 4 is shown in FIG. 7, it can be seen that the base plate 1.1 has two holes between two retaining apparatuses 4 or two storage spaces 3, so that two conveying shafts 5.1 can accordingly be mounted.

Figure 4:
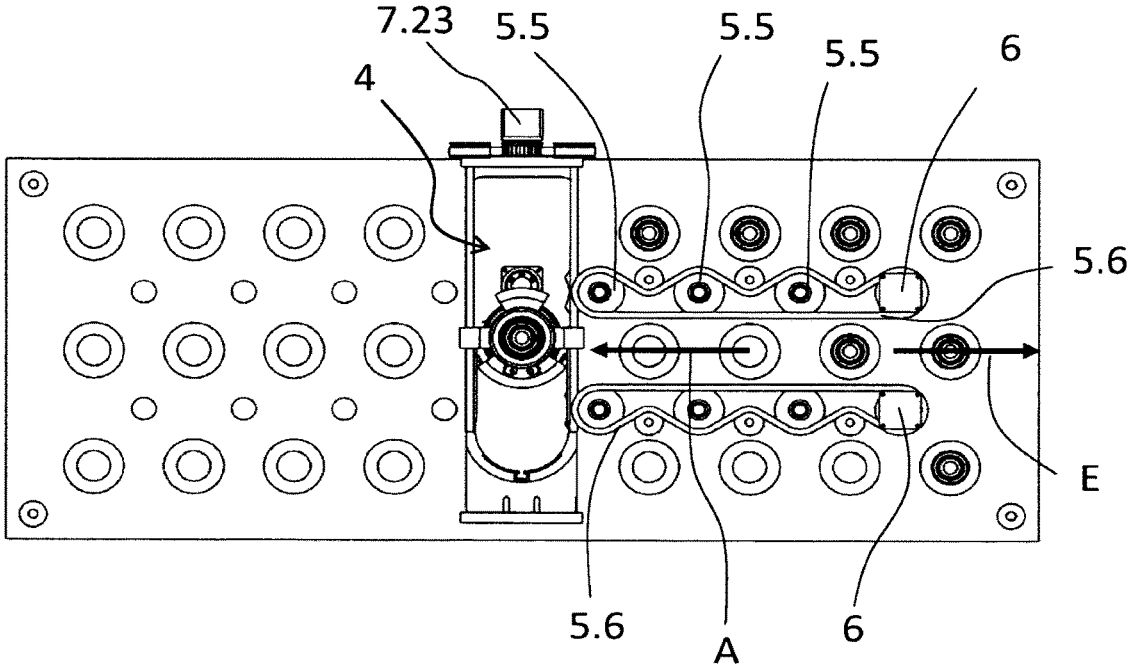
FIG. 4 shows a further sectional view through the magazine to visualize the drive of the conveying device.

For driving the conveying shafts 5.1 regardless of whether one or more conveying shafts 5.1 are provided between two retaining apparatuses 4, each conveying shaft 5.1 has a drive wheel 5.5 at one end. As can be seen in FIGS. 4 and 5, all conveying shafts 5.1 of a conveying device 5 are connected to a common level drive 6 by a coupling element 5.6 designed as a belt. The conveying shafts 5.1 of a conveying device 5 thus all rotate synchronously when an ammunition body 100 is conveyed from one retaining apparatus 4 to an adjacent retaining apparatus 4. Since all conveying shafts 5.1 of a conveying device 5 thus always move together anyway, it is not absolutely necessary, for example when adding ammunition to the magazine 1 or when moving the ammunition bodies 100 in the storage direction E, to move the ammunition bodies one after the other, but for example multiple ammunition bodies 100 in a storage level 2.1, 2.2, 2.3 can also be moved simultaneously. Since conveying devices 5 can also move ammunition bodies 100 of different storage levels 2.1, 2.2, 2.3, thus multiple ammunition bodies 100 in different storage levels 2.1, 2.2, 2.3 can also be moved by a conveying device 5.

For guiding the ammunition bodies 100, guide rails 8 are also provided, which also ensure that the ammunition bodies 100 can only be moved in the storage direction E or in the removal direction A during conveying, but not perpendicular to this, for example. As can be seen in FIG. 5, the guide rails 8 are arranged above and below each storage level 2.1, 2.2, 2.3 and extend essentially perpendicular to the ammunition bodies 100 or perpendicular to the conveying shafts 5.1.

In the case of the guide rails 5.8, which are arranged between two storage levels 2.1, 2.2, 2.3, the struts 4.5 of the respective conveying shafts 5.1 extend through the guide rails 5.8 and the guide rails 8 are arranged at the level of the drive wheels 5.2, 5.3. The drive wheels 5.2, 5.3 can each be designed as double wheels and engage around the guide rails 5.8. As a result, in particular, the guide rails 5.8 which are not arranged in the roof area or in the floor area can then be fixed in a defined position. So that the guide rails 5.8 do not hinder a movement of the retaining apparatus 4 from the transfer position Ü and the retaining position H, the guide rails 5.8 can be rounded in the corresponding regions, which can be seen in FIG. 5 and also in FIG. 3, for example.

Figure 8:
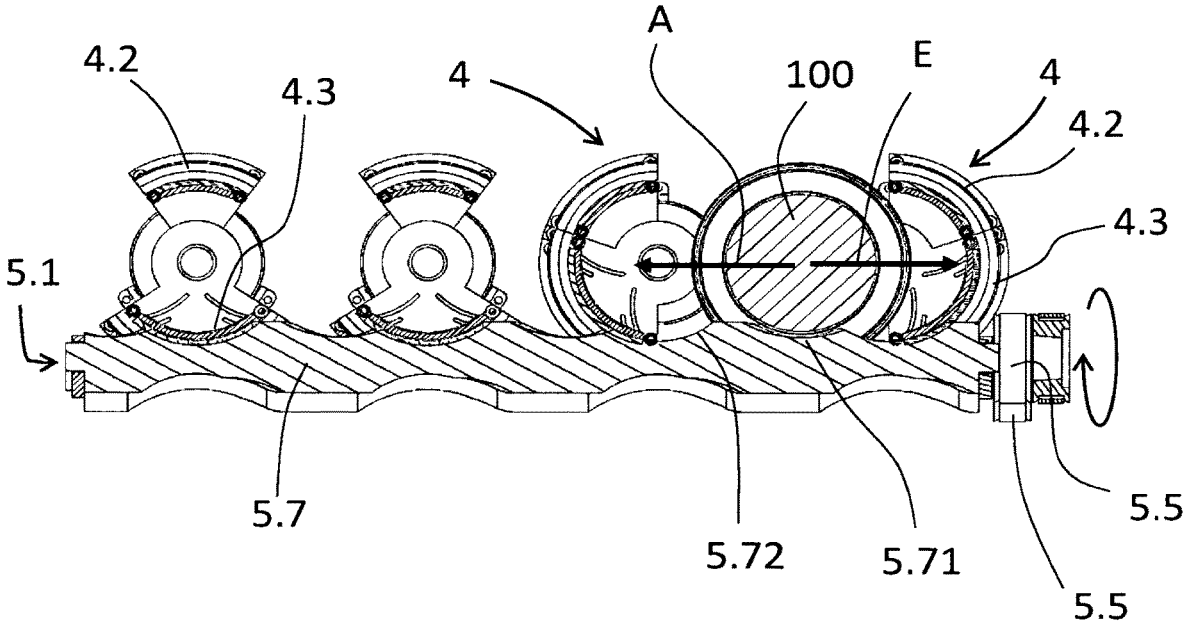
FIG. 8 shows a detailed view of the conveying device of the magazine according to FIG. 7.
Figure 9:
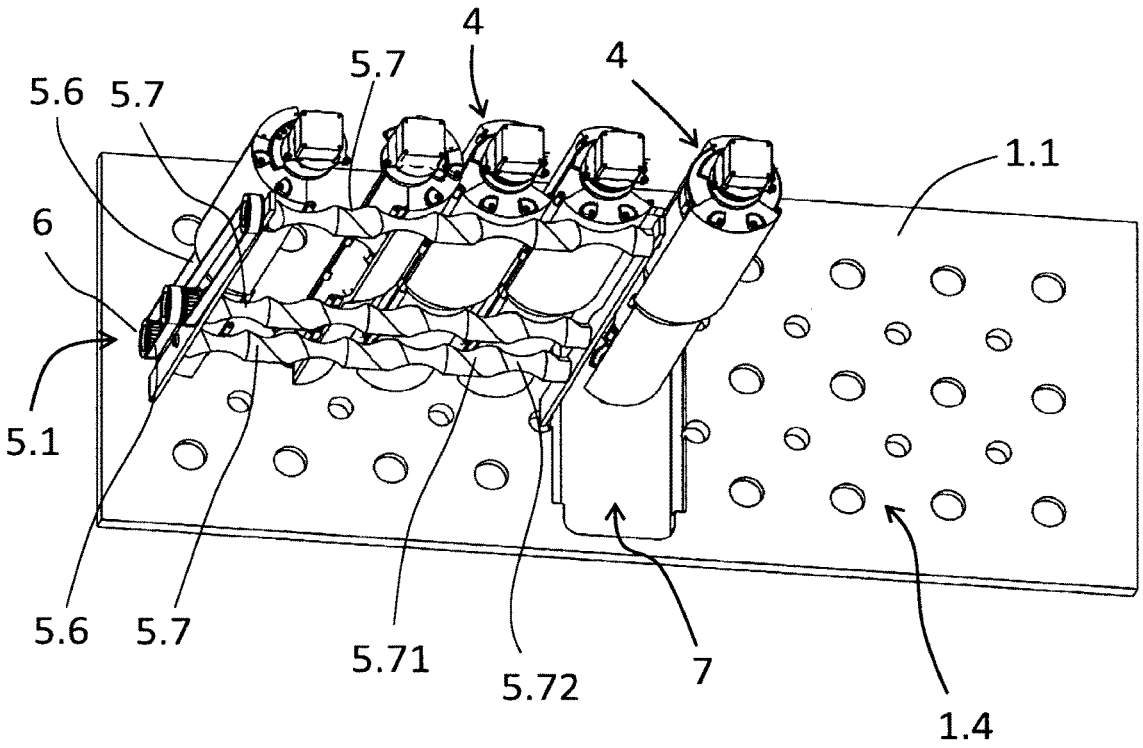
FIG. 9 shows a perspective view of the magazine according to FIG. 7.

In a further embodiment, the conveying devices 5 may have one or more screw rollers 5.7 instead of the conveying shafts 5.1. This embodiment is shown in FIGS. 7 to 9. As can be seen in particular in FIG. 9, the conveying device 5 has three screw rollers 5.7 of different sizes or diameters arranged parallel to each other, with one screw roller 5.7 arranged in the middle, one in the rear and one in the front of the ammunition bodies 100.

Unlike the conveying shafts 5.1, the screw rollers 5.7 do not extend parallel to the longitudinal axes of the ammunition bodies 100, but perpendicular to them. Accordingly, the screw rollers 5.7 are also not rotatably supported in the base plates 1.1, 1.2, but in corresponding rails that extend between the two base plates 1.1, 1.2. As can be seen in FIG. 9, therefore, not all holes of the hole pattern 1.4 are required, in particular not the holes in which the conveying shafts 5.1 are rotatably supported.

The screw rollers 5.7 have alternating constrictions 5.72 and screw guides 5.71. The screw guides 5.71 serve quite analogously to the conveying shafts 5.1 to transport the ammunition bodies 100 from a retaining apparatus 4 to the next retaining apparatus 4 and are arranged accordingly between the retaining apparatuses 4. The screw guides 5.71 are designed in such a way that the ammunition bodies 100 are guided in these and a rotational movement of the screw rollers 5.7 leads to a linear movement of the ammunition bodies 100 in the storage direction E or in the removal direction A, depending on the direction of rotation of the screw roller 5.7. This becomes clear, for example, in FIG. 8, in which the transport of an ammunition body 100 between the two right retaining apparatuses 4 is shown.

The constrictions 5.71 are arranged in the region of the retaining apparatus 4 and ensure that the retaining apparatus 4 can be moved back and forth between the retaining position H and the transfer position Ü. The constrictions 5.71 also serve in this respect that the screw roller 5.7 can reach closer to the longitudinal axis of the ammunition bodies 100, which enables safe conveying of the ammunition bodies 100, as can also be seen in the illustration of FIG. 8.

In order to move the ammunition bodies 100 in a storage level 2.1, 2.2, 2.3, the screw rollers 5.7 of a conveying device 5 must be rotated synchronously. For this purpose, the screw rollers 5.7 each have a drive wheel 5.5, which are coupled to each other by one or more coupling elements 5.6 and rotatable by means of a level drive 6.

Before going into more detail below about the more detailed design of the retaining apparatus 4 and the ammunition elevator 7, the positioning of the magazine 1 in the vehicle 200 and the resulting space conditions will first be explained on the basis of FIGS. 18*a* and 18*b*.

The vehicle 200 has a vehicle hull 201 and a turret 202 rotatably supported relative to the hull with a large-caliber weapon 203. The magazine 1 is arranged in the rear region of the turret 202 and the ammunition bodies 100 are pushed out of the magazine 1 towards the weapon 203 and then fed to the weapon 203. The supply of the ammunition bodies 100 from the magazine 1 to the weapon 203 can be accomplished both manually by a loader but also, for example, automatically by a suitable loading device.

Figure 18A:
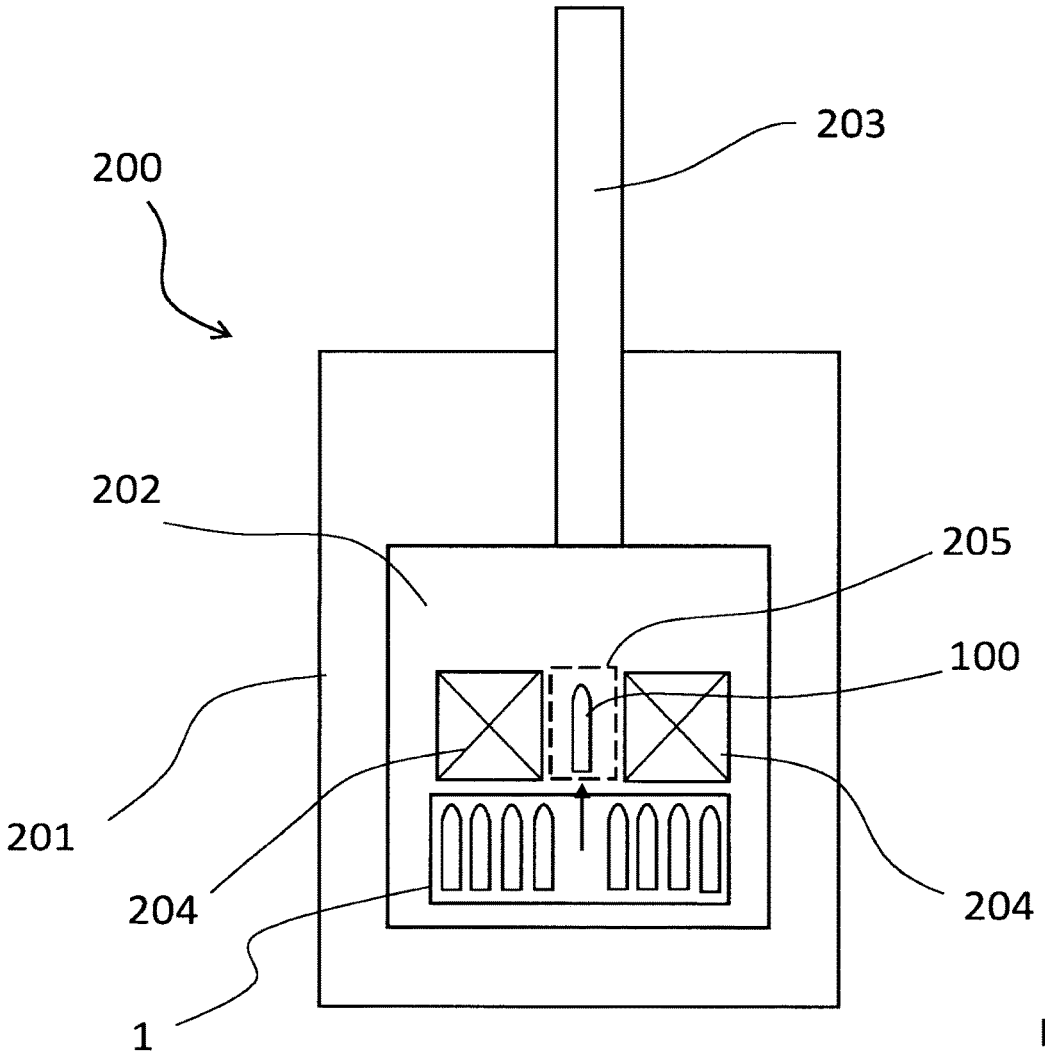
FIG. 18*a* shows a schematic sectional views of a military vehicle.
Figure 18B:
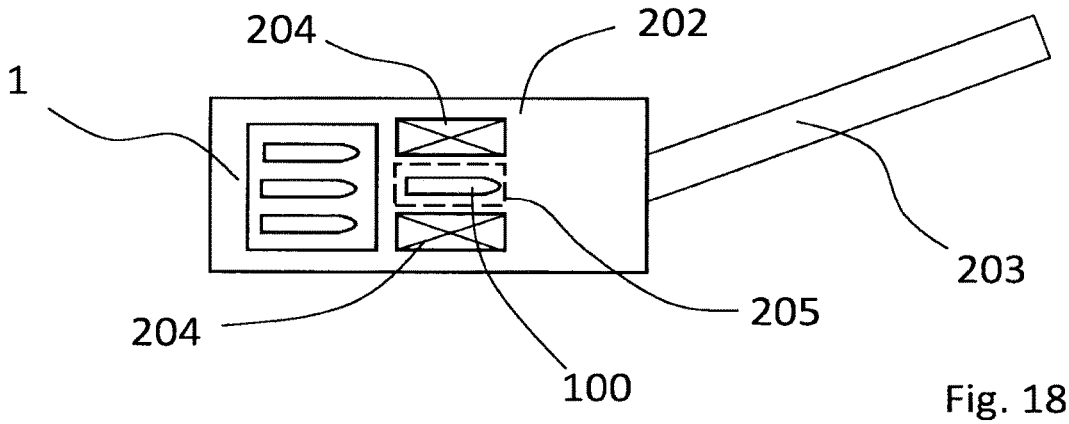
FIG. 18*b* shows a schematic sectional views of a military vehicle.

In the top view of FIG. 18*a* and in the side section view of the turret according to FIG. 18*b*, the ammunition bodies 100 still in the magazine 1 can be seen. The removed ammunition body 100 was, as already described above, first conveyed from its storage space 3 to the ammunition elevator 7 and then moved to the middle storage level 2.2, in which the ammunition body 100 can be pushed out of the magazine 1. Since during removal all ammunition bodies 100 in the magazine 1 are correspondingly first moved to the removal position P and can only then be removed or pushed out, only a small space is required in the region between the magazine 1 and the weapon 203. This can also be seen in the figures. This is because only a small withdrawal space 205 must be kept behind the magazine 1 in the removal position P for the removal of the ammunition body 100, thus in the exemplary embodiment in the middle storage level 2.2 behind the ammunition elevator 7 in the middle of the magazine 1. The free spaces 204 located next to the removal space 205, on the other hand, can be used in other ways and are not needed for the removal of an ammunition body 100. Due to the defined removal position P, which is identical for all ammunition bodies 100, the space requirement of the magazine 1 or the space requirement for the removal of an ammunition body 100 can be significantly reduced.

The design and function of the retaining apparatus 4 is described in more detail below, in particular on the basis of FIGS. 14 to 17.

Figure 13A:
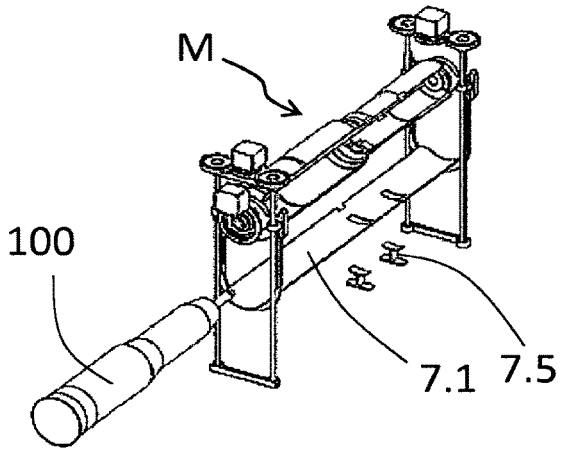
FIG. 13*a* shows a perspective view of the ammunition elevator during one step of the storage of an ammunition body.
Figure 13B:
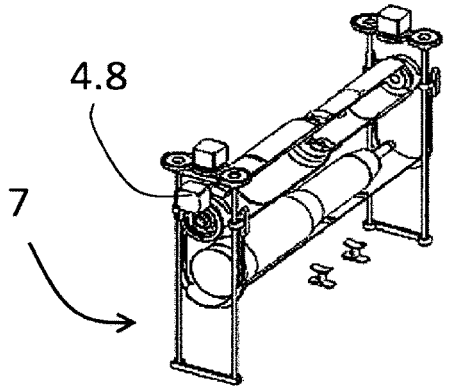
FIG. 13*b* show a perspective views of the ammunition elevator during one step of the storage of an ammunition body.
Figure 13C:
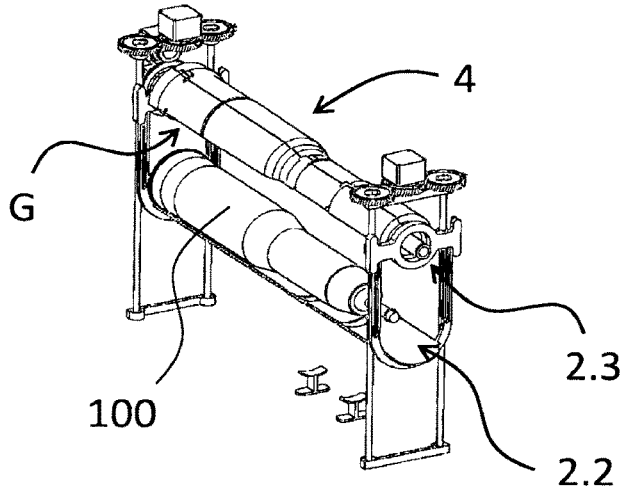
FIG. 13*c* shows a perspective view of the ammunition elevator during one step of the storage of an ammunition body.
Figure 13D:
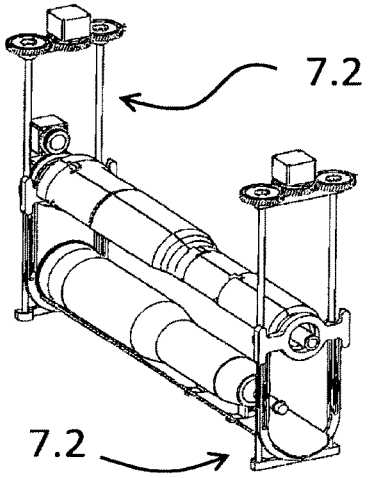
FIG. 13*d* shows a perspective view of the ammunition elevator during one step of the storage of an ammunition body.
Figure 13E:
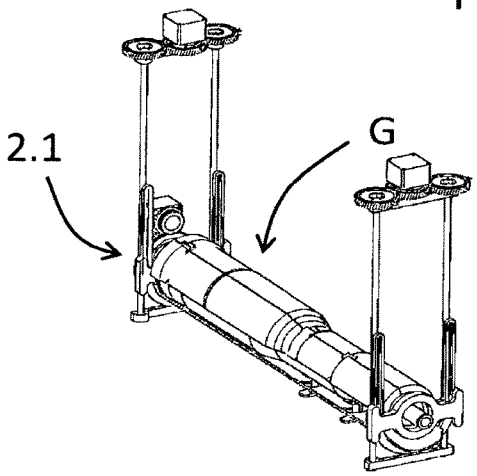
FIG. 13*e* shows a perspective view of the ammunition elevator during one step of the storage of an ammunition body.
Figure 13F:
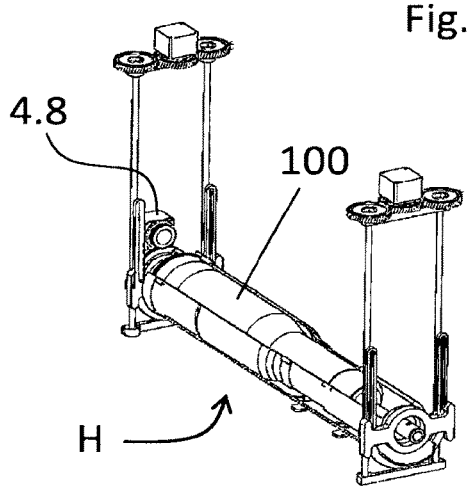
FIG. 13*f* shows a perspective view of the ammunition elevator during one step of the storage of an ammunition body.
Figure 13G:
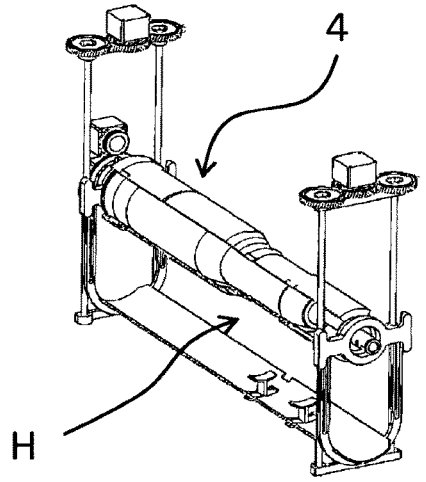
FIG. 13*g* shows a perspective view of the ammunition elevator during one step of the storage of an ammunition body.
Figure 14:
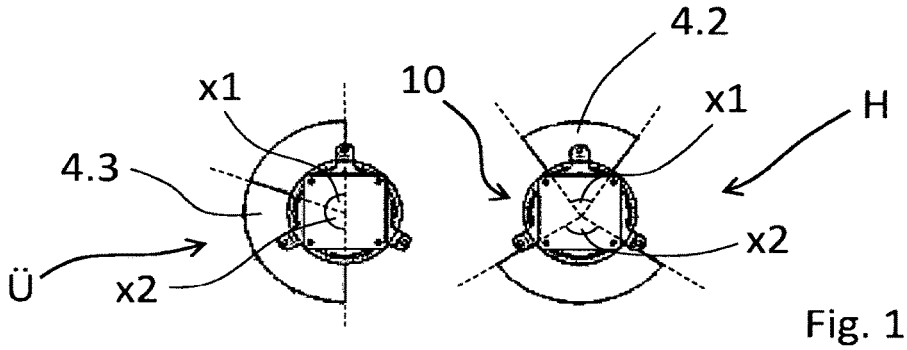
FIG. 14 shows a front view of the retaining apparatus in the transfer position and in the retaining position.

FIG. 14 shows the retaining apparatus 4 in a perspective side view and in a retaining position H. The retaining apparatus 4 consists essentially of two retaining shells 4.2, 4.3, which are rotatably coupled to each other in a front end region 4.22 by a rotary bearing 4.6 and in a rear end region 4.21 by a retaining shell drive mechanism 4.9. In the retaining position H, the two retaining shells 4.2, 4.3 are opposite each other in such a way that an ammunition body 100 is accommodated in a form-fitting manner in the retaining region 4.10 located between the two retaining shells 4.2, 4.3 and cannot be removed from the retaining apparatus 4. This is also shown, for example, in FIG. 13*g*.

In order to remove the ammunition body 100 from the retaining apparatus 4, it is necessary to move the two retaining shells 4.2, 4.3 relative to each other and to rotate them around the rotation axis D. The movement of the two retaining shells 4.2, 4.3 can be seen, for example, in FIG. 14. In the right position of FIG. 14 the retaining apparatus 4 is or the two retaining shells 4.2, 4.3 are in the retaining position H. In order to remove an ammunition body 100 from the retaining apparatus 4, the upper retaining shell 4.2 is rotated counterclockwise and the lower retaining shell 4.3 is rotated clockwise around the rotation axis D until the two retaining shells 4.2, 4.3 are in contact with each other, as can be seen in the left illustration of FIG. 14.

The upper retaining shell 4.2 and the lower retaining shell 4.3 are each designed as cylinder segments and have different segment angles x1, x2. The lower retaining shell 4.3 is larger than the upper retaining shell 4.2 and has a larger segment angle x2, so that the force or weight of the ammunition bodies 100 is distributed over a larger area. The retaining shell 4.2 which has the smaller segment angle x1 only has to absorb a comparatively small force and is primarily used to secure the ammunition body 100 in the lower retaining shell 4.3.

In order for an ammunition body 100 in the transfer position Ü either to be removed from the retaining apparatus 4 or to be inserted into the retaining apparatus 4, the sum of the segment angles x1, x2 is about 180 degrees, as can be seen in the left illustration of FIG. 14. If the sum of the segment angles were greater than 180 degrees, an ammunition body 100 could not be removed from the retaining apparatus 4, even if the two retaining shells 4.2.4.3 are in contact with each other. If, on the other hand, the sum of the segment angles x1, x2 were significantly smaller than 180 degrees, the strength of the retaining shells 4.2, 4.3 would be reduced.

Figure 13H:
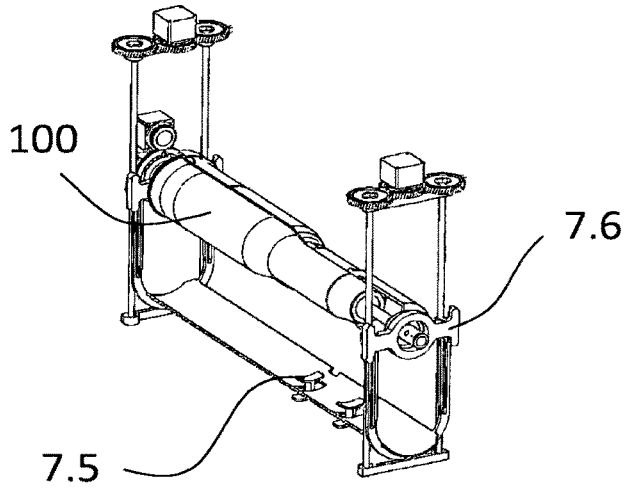
FIG. 13*h* shows a perspective view of the ammunition elevator during one step of the storage of an ammunition body.
Figure 15:
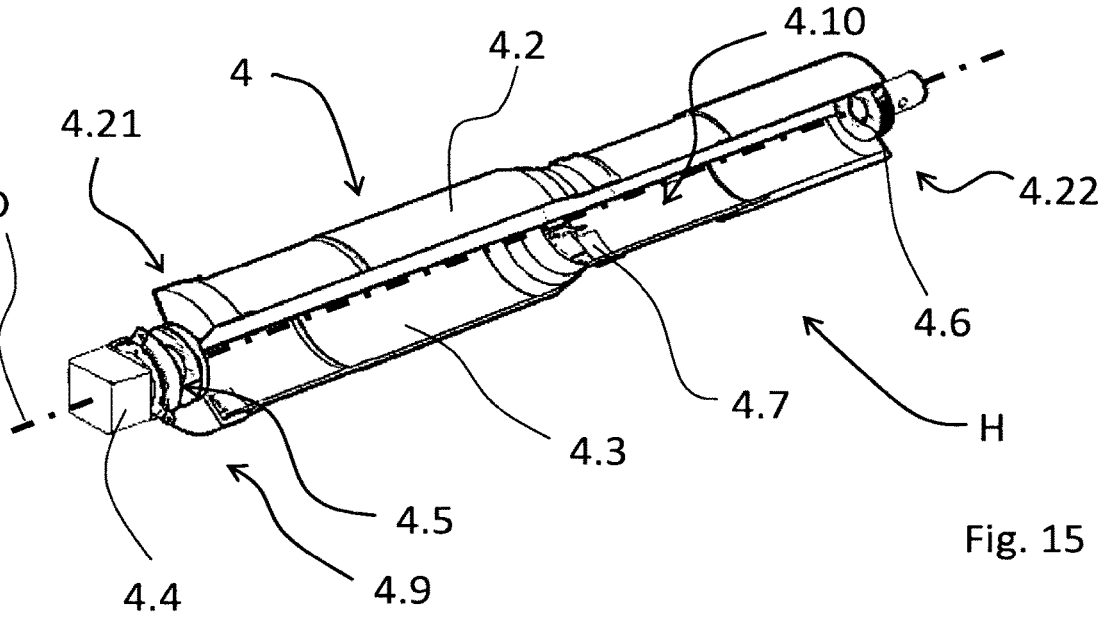
FIG. 15 shows a perspective side view of the retaining apparatus.

As can also be seen in FIG. 15 or FIG. 13*h*, the two retaining shells 4.2, 4.3 are adapted to the contour of the ammunition body 100. Thus, the distance of the two retaining shells 4.2, 4.3 from the rotation axis D, which also corresponds to the longitudinal axis of the ammunition bodies 100, is greater in the rear end region 4.21 than in the front end region 4.22, exactly as is also the case with the ammunition bodies 100.

The lower retaining shell 4.3 has an ejection device designed as an ejection latch 4.7, which is designed as a passive spring. When inserting an ammunition body 100, the ejection latch 4.7 is tensioned by the weight of the ammunition body 100. When the lower retaining shell 4.3 is rotated around the rotation axis D and moved to the transfer position Ü, the ejection latch 4.7 ensures that the ammunition body 100 is automatically ejected from the retaining apparatus 4.

In FIG. 8, for example, it can be seen that the two right retaining shells 4 are located in the transfer position Ü. The ammunition body 100 was initially located in the right retaining apparatus 4 and was retained by this in the corresponding storage space 3. In order to move the ammunition body 100 from the magazine 1 to the ammunition elevator 7 for removal, the retaining apparatus 4 was first transferred from the retaining position H to the transfer position Ü. The ammunition body 100 is moved by the ejection latch 4.7 to the conveying device 5, which then conveys the ammunition body 100 to the adjacent retaining apparatus 4. To receive the ammunition body 100, this retaining shell 4 is also located in the transfer position Ü, as can be seen in FIG. 8. When the ammunition body 100 has been conveyed by the conveying device 5 and has reached the retaining apparatus 4, the two retaining shells 4.2, 4.3 of the retaining apparatus 4 are transferred to the retaining position H. The upper retaining shell 4.2 is rotated clockwise around the rotation axis D and the lower retaining shell 4.3 counterclockwise.

If the ammunition body 100 is to be retained in the retaining apparatus 4, the retaining apparatus 4 remains in the retaining position H. If the ammunition body 100 is to be conveyed further in the removal direction A, the retaining shells 4.2, 4.3 are rotated further around the rotation axis D until they lie next to each other on the other side of the ammunition body 100. The position of the retaining apparatus 4 then corresponds to that of the right retaining apparatus 4 of FIG. 8 and the ammunition body 100 can be moved further in the removal direction A.

In order to move the two retaining shells 4.2, 4.3 in the manner described above and to transfer them from the retaining position H to the transfer position Ü or vice versa, the retaining shell drive mechanism 4.9 has a retaining shell drive 4.4 in the form of a motor and a gearbox 4.5. The gearbox 4.5 is designed in such a way that both retaining shells 4.2, 4.3 can be moved by only one motor.

Figure 16:
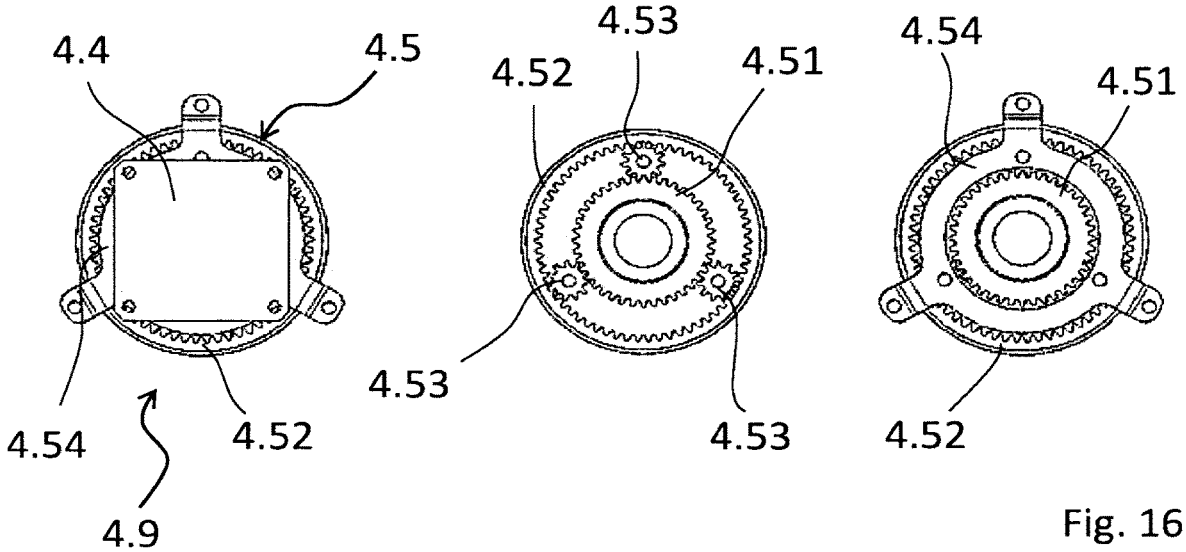
FIG. 16 shows different views of the retaining shell drive mechanism.

The design of the gearbox 4.5 can be seen in FIG. 16. The gearbox 4.5 is designed as a planetary gearbox and has an outer hollow wheel 4.52, an inner sun wheel 4.51 and three planetary gears 4.53, which mesh with the hollow wheel 4.52 and the sun wheel 4.51. The three planetary wheels 4.53 are connected to each other by a bridge 4.54 and ensure that the hollow wheel 4.52 and the sun wheel 4.51 rotate in opposite directions. When the sun wheel 4.51 is rotated clockwise, the hollow wheel 4.52 thus rotates counterclockwise, but around the same rotation axis D. The hollow wheel 4.52 is connected to the upper retaining shell 4.2 and the sun wheel 4.51 is connected to the lower retaining shell 4.3, so that both retaining shells 4.2, 4.3 can be rotated in the opposite direction around the rotation axis D by a single retaining shell drive 4.51 connected to the sun wheel 4.51.

In addition to the relative movement of the two retaining shells 4.2, 4.3 around the rotation axis D, it is also possible to rotate both retaining shells 4.2, 4.3 together around the rotation axis D. This can be seen in FIGS. 13*c* and 13*h*, for example. This is because the retaining apparatus 4 is located in the transfer position Ü in both illustrations, yet the two retaining shells 4.2, 4.3 are rotated together by about 90 degrees around the rotation axis D.

Figure 2:
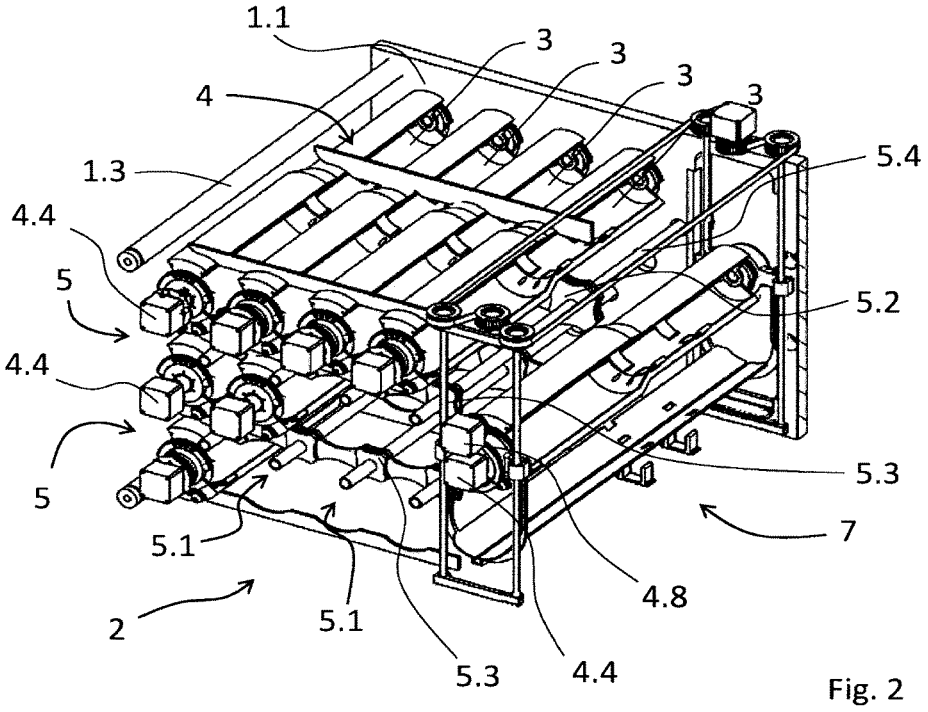
FIG. 2 shows a perspective detailed view of a storage area of the magazine according to FIG. 1.
Figure 17:
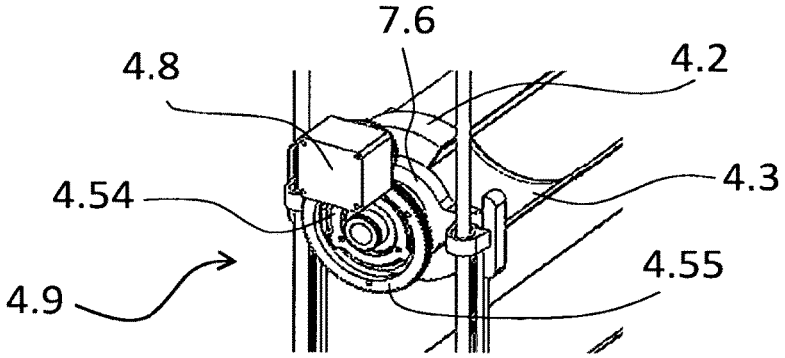
FIG. 17 shows a perspective view of the retaining shell drive mechanism.

In order to rotate the two retaining shells 4.2, 4.3 together, another motor in the form of a rotary drive 4.8 is provided, which can be seen in FIG. 17, for example. For the sake of better clarity, FIG. 17 does not show the retaining shell drive 4.4, but both drives 4.4, 4.8 are shown in FIG. 1 or 2, for example. The rotary drive 4.8 drives a gear ring 4.55 to which the bridge 4.54 is attached. By means of the rotary drive 4.8, the entire gearbox 4.5 and also the retaining shell drive 4.4 are thus rotated around the rotation axis D, without the retaining shells 4.2, 4.3 moving relative to each other. In order to transfer the retaining shells 4.2, 4.3 to their desired position as quickly as possible, both drives 4.4, 4.8 can also be operated simultaneously.

At the storage spaces 3 it is usually not necessary that the two retaining shells 4.2, 4.3 are also rotated together around the rotation axis D, but for the retaining apparatus 4 basically the two transfer positions U and the retaining position H shown in FIG. 8 are sufficient. The rotary drive 4.8 is primarily required for the ammunition elevator 7 described below, since the retaining apparatus 4 or the retaining shells 4.2, 4.3 can also be rotated into a grabbing position G by means of this. For this reason, no rotary drive 4.8 is provided in the retaining apparatus 4 of the various storage spaces 3 of the magazine 1 and the respective retaining shells 4.2, 4.3 are only rotatable relative to each other by the retaining shell drive 4.4.

The corresponding bridges 4.54 therefore do not have to be moved but are screwed to the base plate 1.2 of the magazine 1. Due to the fact that the planetary gears 4.53 are rotatably supported on the bridge 4.54, they thus also serve as a rotary bearing of the retaining apparatus 4 on the base plate 1.2. FIG. 1 also shows the configuration of the hole pattern 1.4 on the outside of the base plate 1.2, so that the hollow wheel 4.52 can be accommodated, for example, in the base plate 1.2 and does not protrude from the base plate 1.2. On the opposite base plate 1.1, the rotary bearings 4.6 are plugged into the base plate 1.1, so that the two retaining shells 4.2, 4.3 are also rotatably supported on this base plate 1.1.

The retaining shell drive mechanism 4.9 is located at the end of the retaining apparatus 4, which serves to accommodate the lower ends of the ammunition bodies 100. As can be seen, for example, in FIGS. 1 and 2, the retaining shell drive 4.4 of the retaining apparatuses 4, which are assigned to the storage spaces 3 of the magazine 1, is arranged on the same side. The level drives 6 for driving the conveying devices 5, on the other hand, are arranged on the other side of the magazine 1, so that the level drives 6 and the retaining shell drives 4.4 are opposite each other relative to the magazine 1.

The common rotation of the retaining shells 4.2, 4.3 is required in particular for the ammunition elevator 7 described in more detail below on the basis of FIGS. 11 to 13.

FIGS. 19*a* and 19*b* will be used below to describe a possibility for driving the ejection latches 4.7 by means of an ejection mechanism 4.11. In the front and rear regions of the retaining shells 4.2, 4.3, an ejection drive 4.11 is provided for this purpose, by means of which the ammunition bodies 100 can be ejected from the retaining shells 4.2, 4.3 laterally and basically also independently of gravity.

As has already been described, the lower retaining shell 4.3 is equipped with multiple ejection latches 4.71, 4.72, namely in the front region with two front ejection latches 4.71 and in the rear region with a rear ejection latch 4.72. Each ejection latch 4.71, 4.72 has two latch elements which can be moved independently of each other and which are pivotably supported at one end in the lower retaining shell 4.3. The right and left latch elements of the front ejection latches 4.71 are each connected to a front ejection pinion 4.15 by means of a rod not visible in the figure. When the ejection pinion 4.15 is rotated, the connected latch elements of the ejection latches 4.71 rotate accordingly. The latch elements of the rear ejection latch 4.72 are connected in a corresponding manner to the two rear ejection pinions 4.14 to be seen in FIG. 19*a* and can be moved by means of them.

To drive the ejection latches 4.71, 4.72, the respective ejection pinions 4.15, 4.14 of the ejection drives 4.11 must be rotated, namely either the front and rear right ejection pinions 4.14, 4.15 or the front and rear left ejection pinions 4.14, 4.15.

In order to move the ejection pinions 4.14, 4.15 accordingly, the upper retaining shell 4.2 in the front and rear end regions 4.22, 4.21 is respectively connected to a toothed segment 4.12, 4.13, which can be rotated around the rotation axis D together with the retaining shell 4.2. If the upper retaining shell according to the illustration of FIG. 19*a* is rotated clockwise, the toothed segments 4.12, 4.13 are moved towards the right ejection pinions 4.14, 4.15. However, as long as the toothed segments 4.12, 4.13 have not yet reached the ejection pinions 4.14, 4.15, they do not yet move. Only shortly before the two retaining shells 4.2, 4.1 come into contact with each other do the toothed segments 4.12, 4.13 engage with the ejection pinions 4.14, 4.15. In the example shown, the distance between the two retaining shells 4.2, 4.3 at the beginning of meshing is about 22 degrees. In this last swivel range of the retaining shells 4.2, 4.3, before they contact other, the toothed segments 4.12, 4.13 then turn the drive pinions 4.14, 4.15 counterclockwise. This movement is transmitted accordingly to the right latch elements of the ejection latches 4.71, 4.72, so that the latch elements then move the ammunition body 100 towards the opening created between the two retaining shells 4.2, 4.3 and thus push it out of the retaining region 4.10 to the left.

When the retaining shells 4.2, 4.3 are then moved back to the retaining position H, the drive pinions 4.14, 4.15 are rotated in the opposite direction until the toothed segments 4.12, 4.13 are disengaged again and the latch elements have again reached the position shown in FIGS. 19*a* and 19*b*.

If an ammunition body 100 is to be ejected to the other side, the retaining shells 4.2, 4.3 are accordingly rotated in the opposite direction and the toothed segments 4.12, 4.13 then drive the other drive pinions 4.14, 4.15 accordingly. According to the illustration of FIG. 19*a*, the left latch elements are then operated and these push the ammunition body 100 out of the retaining region 4.10 to the right. Due to the described forced coupling, no additional motor is required for the ejection of the ammunition bodies 100, but by means of the basically purely passive ejection drive 4.11, the ammunition bodies 100 can be ejected automatically when the retaining shells 4.2, 4.3 have reached the corresponding position, for example the transfer position Ü.

Figure 13I:
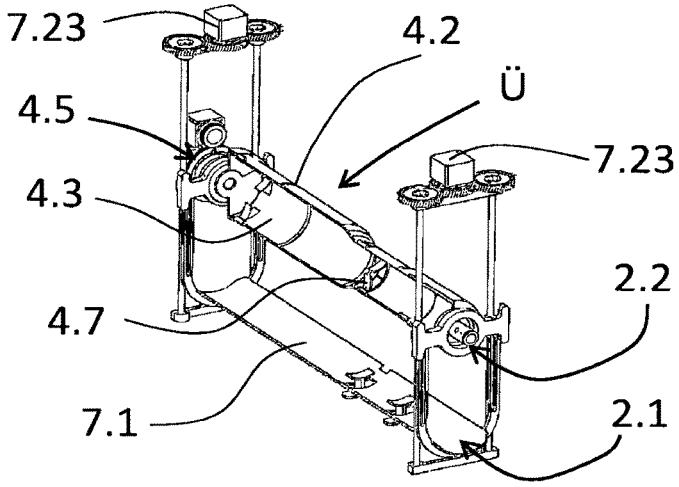
FIG. 13*i* shows a perspective view of the ammunition elevator during one step of the storage of an ammunition body.

As is noticeable, for example, in a comparison of the ejection latches 4.71, 4.2 of FIGS. 19*a* and 19*b* with those of FIG. 13*i*, the ejection latches 4.7 shown in FIG. 13*i* engage rather in the lower region of the ammunition bodies 100, whereas the ejection latches 4.71, 4.72 according to FIGS. 19*a*, 19*b* rather press the ammunition bodies 100 laterally from the retaining shells 4.2, 4.3. This is accompanied by the fact that the latch elements of the ejection latches 4.71, 4.72 are supported in the retaining shell 4.3 in the mutually facing end regions, whereas the latch elements of the ejection latch 4.7 according to FIG. 13*i* are pivotably supported in the end regions facing away from each other. The ejection latches 4.71, 4.72 can therefore also protrude from the retaining shell 4.3 and contribute to secure lateral support of the ammunition bodies 100 in the retaining shell 4.3.

As can be seen in FIG. 1, the ammunition elevator 7 is arranged in the middle of the magazine 1 and divides the magazine 1 into two storage areas 2, each of which has 12 storage spaces 3 for the ammunition bodies 100. These storage spaces 3 are divided into three storage levels 2.1, 2.2, 2.3 arranged one above the other and each with four storage spaces 3. By means of the ammunition elevator 7, the individual storage levels 2.1, 2.2, 2.3 can be populated with ammunition bodies 100 or ammunition bodies 100 can be conveyed from the storage levels 2.1, 2.2, 2.3 to the removal position P, at which the ammunition bodies 100 can be removed from the magazine 1 or at which the ammunition bodies 100 can be conveyed out of the magazine 1.

Figure 11:
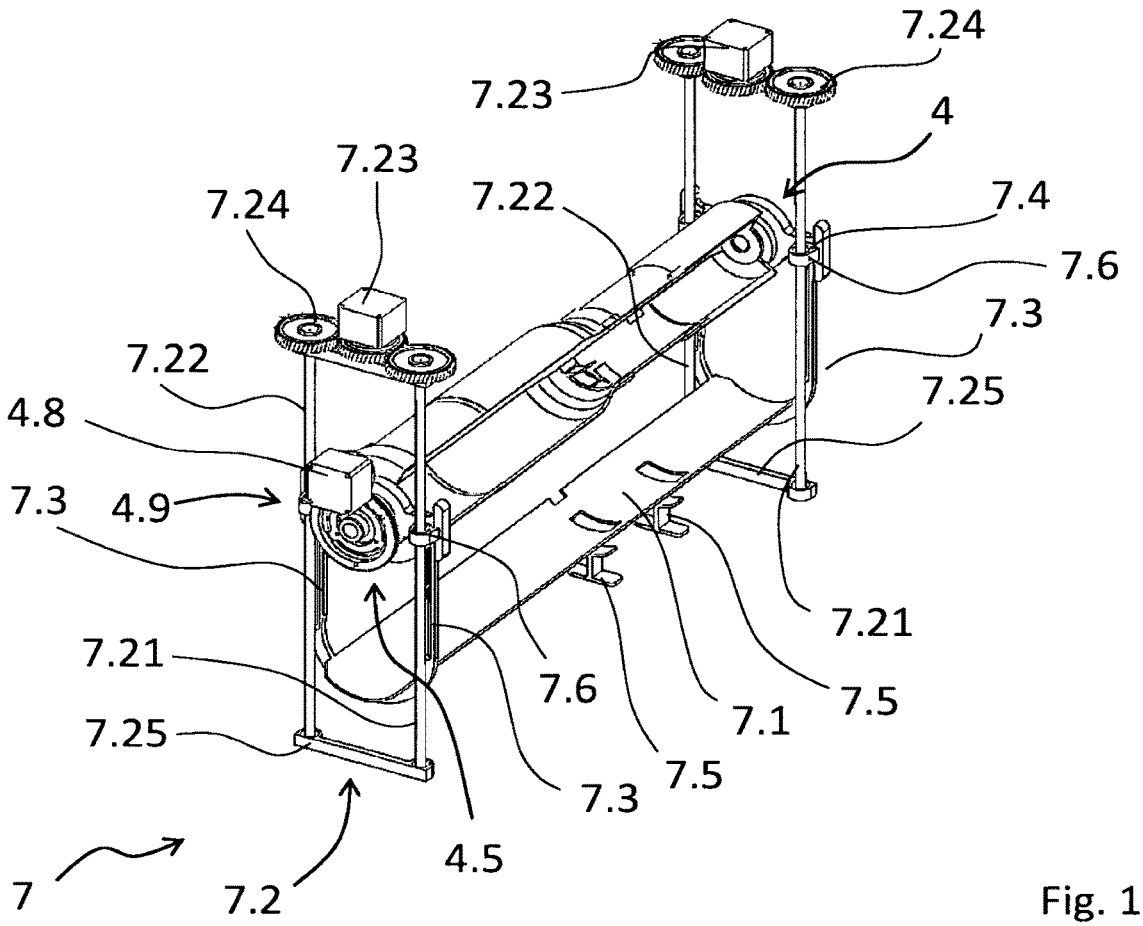
FIG. 11 shows a perspective detailed view of the ammunition elevator.

In the illustration of FIG. 11, the ammunition elevator 7 is shown in a perspective representation isolated from the magazine 1. The ammunition elevator 7 has a receiving shell 7.1, which can be moved in the vertical direction and a retaining apparatus 4, which can also be moved in the vertical direction. The retaining apparatus 4 used in the ammunition elevator 7 is the same retaining apparatus 4 which is also used to hold the ammunition bodies 100 in the storage spaces 3 and which has already been described above.

The ammunition elevator 7 also has two linear drives 7.2, by means of which the retaining apparatus 4 can be moved in the vertical direction. Each of the two linear drives 7.2 has two threaded spindles 7.21, 7.22, which are rotatably supported at their lower ends in a bearing rail 7.25 and which extend parallel to each other in the vertical direction and perpendicular to the rotation axis D of the retaining apparatus 4 or to the longitudinal axis of the ammunition body 100. In order to move the retaining apparatus 4, a guide element 7.6 is provided, which is arranged as a type of a spindle nut on the two threaded spindles 7.21, 7.22 of the linear drive 7.2. If the two threaded spindles 7.21, 7.22 rotate uniformly, the guide element 7.6 can thus be moved up and down in the vertical direction.

As can also be seen in FIG. 11, the retaining apparatus 4 is mounted on the guide element 7.6, so that the retaining apparatus 4 can be moved accordingly by means of the guide element 7.6. In order to ensure uniform movement of the retaining apparatus 4, it is connected both in the front end region 4.21 and in the rear end region 4.22 to a corresponding guide element 7.6, which can be moved in each case by means of a linear drive 7.2. Thus, the weight of an ammunition body 100 can be supported by two linear drives 7.2 or correspondingly by four threaded spindles 7.21, 7.22.

In order to securely connect the ammunition elevator 7 to the magazine 1 or to the two storage areas 2, the bearing rail 7.25 can be connected to a base plate 1.1, 1.2 of the magazine 1 and also the threaded spindles 7.21, 7.22 can be rotatably connected to the magazine 1. Thus, the forces generated by the reception of an ammunition body 100 can be safely absorbed.

To prevent the guide elements 7.6 from tilting, all four threaded spindles 7.21, 7.22 must be rotated in the same direction at approximately the same speed. Each linear guide 7.2 has a lifting motor 7.23 for this, which is connected via a gearbox 7.24 to the two threaded spindles 7.21, 7.22, so that the two threaded spindles 7.21, 7.22 accordingly rotate synchronously. The respective lifting motors 7.23 of the two linear drives 7.2 are also controlled simultaneously, so that there is a synchronous rotational movement of all four threaded spindles 7.21, 7.22.

Although the receiving shell 7.1 cannot be moved directly in the vertical direction by means of the linear drives 7.2, the receiving shell 7.1 is coupled to the retaining apparatus 4 or to the linear guide 7.3. The coupling depends on the position or storage level 2.1, 2.2, 2.3 of the magazine 1 in which the retaining apparatus 4 is located. If the retaining apparatus 4 is in or above a limit level 2.2, the receiving shell 7.1 is coupled to the retaining apparatus 4 and can be moved together with it in a vertical direction. However, if the retaining apparatus 4 has been moved below the limit level 2.2, the coupling is released and the retaining apparatus 4 is then movable independently of the receiving shell 7.1. In the exemplary embodiment, the middle storage level 2.2 is the limit level 2.2, so that below this level the retaining apparatus 4 can be moved independently and thus also relative to the receiving shell 7.1, and above the middle storage level 2.2 the receiving shell 7.1 is movable together with the retaining apparatus 4. This is explained in more detail below on the basis of the different positions in FIG. 13.

FIG. 13*a* first shows the ammunition loading position M, in which an ammunition body 100 can be pushed into the magazine 1 or pushed onto the receiving shell 7.1. The receiving shell 7.1 is located in the middle storage level 2.2 and the retaining apparatus in the upper storage level 2.3.

In a next step, the retaining apparatus 4 is then transferred from the retaining position H to the transfer position Ü, as can be seen in FIG. 13*c*. The retaining apparatus 4 is then lowered by turning the threaded spindles 7.21, 7.22. During this movement, the receiving shell 7.1 also moves accordingly until it has reached the lower storage level 2.1.

The receiving shell 7.1 is guided by a linear guide 7.3 in the guide element 7.6. At the upper end of the linear guide 7.3, stops 7.4 are provided which ensure that the receiving shell 7.1 is suspended on the retaining apparatus 4 or on the guide element 7.6 if the receiving shell 7.1 is above the lowest storage level 2.1. FIGS. 11 and 12 also show that the receiving shell 7.1 is suspended below the retaining apparatus 4 and moves with it.

The distance of the receiving shell 7.1 from the retaining apparatus 4 corresponds for the position according to FIGS.

13*a* to 13*d* to the distance of the different storage levels 2.1, 2.2, 2.3. If the receiving shell 7.1 has reached the lowest storage level 2.1, this cannot be lowered further, so that then the retaining apparatus 4 moves towards the receiving shell 7.1 during further lowering and the movements are no longer coupled. The guide element 7.6 then slides down the linear guides 7.3 of the receiving shell 7.1 during this movement. Due to the common rotation of the two retaining shells 4.2, 4.3 of the retaining apparatus 4 by the rotary drive 4.8, the two retaining shells 4.2, 4.3 can be rotated into a grabbing position G, in which the retaining shells 4.2, 4.3 grab an ammunition body 100 from above or rest on top of it from above, as shown in FIG. 13*e*. The grabbing position G basically corresponds to a 90-degree rotated transfer position Ü, as can also be seen when comparing FIG. 13*c* and the left illustration of FIG. 14.

In a next step, the retaining apparatus 4 is then moved to the retaining position H and the ammunition body 100 is grabbed by the two retaining shells 4.2, 4.3 of the retaining apparatus 4 in the manner of a grabber, so that this is then accommodated between the retaining shells 4.2, 4.3 or in the retaining region 4.10 in a form-fitting manner.

If the threaded spindles 7.21, 7.22 are then rotated in the opposite direction and the retaining apparatus 4 moves upwards again, the ammunition body 100 is lifted off the receiving shell 7.1 in a vertical direction. This can be seen in FIG. 13*g*. The retaining apparatus 4 can then be moved to the storage level 2.1, 2.2, 2.3 in which the ammunition body 100 is to be stored. The guide element 7.6 then slides upwards again on the linear guide 7.3 until the end of the linear guide 7.3 is reached and the stops 7.4 prevent further relative movement between the retaining apparatus 4 and the receiving shell 7.1. If the retaining apparatus 4 is then moved even further upwards, the stops 7.4 ensure that the receiving shell 7.1 is moved with it so that the retaining apparatus 4 and the receiving shell 7.1 then move upwards uniformly at a distance from a storage level 2.1, 2.2, 2.3.

In FIGS. 13*h* and 13*i*, the retaining apparatus 4 has grabbed an ammunition body 100, has lifted it off from the receiving shell 7.1 and was then moved to the second storage level 2.2. If the acquired ammunition body 100 is now to be stored in the second storage level 2.2, the two retaining shells 4.2, 4.3 are moved to the transfer position Ü and rotated together around the rotation axis D by the rotary drive 4.8 until the position shown in FIG. 13*h* is reached. In this position, the ammunition body 100 can then be ejected from the retaining apparatus 4 and fed to the conveying device 5, which then transports the ammunition body 100 to the first retaining apparatus 4 of the corresponding storage level 2.2. Due to the rotating of the two retaining shells 4.2, 4.3, it is achieved that the ammunition body 100 can be ejected from the retaining apparatus 4 not only to the right, but also to the left. For this purpose, the retaining shells 4.2, 4.3 would have to be rotated from the position shown in FIG. 13*h* in the opposite direction around the rotation axis D until the retaining shells 4.2, 4.3 are on the other side of the ammunition body 100. Theoretically, it would also be possible to rotate the retaining shells 4.2, 4.3 together by 180 degrees around the rotation axis D in order to eject the ammunition body 100 to the other side. Then, however, the smaller retaining shell 4.2 would be below the larger retaining shell 4.3, which could lead to stability problems.

In order for the retaining apparatus 4 or the two retaining shells 4.2, 4.3 to be rotatable in the manner described above and so that the retaining shells 4.2, 4.3 in the ammunition elevator 7 can be rotated into the retaining position H, the grabbing position G and the transfer position Ü, it is necessary to rotate the retaining shells 4.2, 4.3 relative to the guide elements 7.6. The retaining shells 4.2, 4.3 are rotatably supported in the guide elements 7.6 for this purpose, so that the two retaining shells 4.2, 4.3 can be rotated by the retaining shell drive 4.4 from the retaining position H to the transfer position Ü and by the rotary drive 4.8 from the transfer position U to the grabbing position G. Since the gearbox 4.5 and the retaining shell drive 4.4 also rotate around the rotation axis D during the joint rotation of the two retaining shells 4.2, 4.3 around the rotation axis D, these are also accordingly rotatably supported on the guide element 7.6. The rotary drive 4.8 is not rotatable relative to the guide element 7.6, so that it can be firmly connected to the guide element 7.6.

In order to remove an ammunition body 100 from the magazine 1, it must first be fed from the corresponding storage level 2.1, 2.2, 2.3 to the ammunition elevator 7, then deposited on the receiving shell 7.1 and then moved to the removal position P. In the case of the magazine 1 shown in the figures, both the ammunition loading position M and the removal position E of the receiving shell 7.1 or the ammunition body 100 are located in the middle storage level 2.2. In order to place the ammunition body 100 on the receiving shell 7.1, the retaining apparatus 4 retaining the ammunition body 100 must first be moved to the lowest storage level 2.1. Then the retaining shells 4.2, 4.3 are rotated around the rotation axis D into the grabbing position G, as shown in FIG. 13*e*. In a next step, the retaining apparatus 4 is then moved upwards in this grabbing position G without the ammunition body 100. The ammunition body 100 remains on the receiving shell 7.1. In order to convey the ammunition body 100 to the second storage level 2.2, in which it can be pushed out of the receiving shell 7.1 and then fed to the weapon, the retaining apparatus 4 must be moved to the highest storage level 2.3. This can be seen, for example, in FIG. 12. The ammunition body 100 can then be pushed out of the receiving shell 7.1 in this removal position E, for example by a thrust element which is not shown in the illustrations.

Furthermore, it is not absolutely necessary to store the ammunition bodies 100 in the magazine 1 from the ammunition loading position M, in which the ammunition bodies 100 are on the receiving shell 7.1, but since the receiving shell 7.1 is open at both ends, the ammunition bodies 100 can also be directly pushed out of the receiving shell 7.1 again and then fed to the weapon. In this respect, the removal position E of the ammunition elevator 7 also corresponds exactly to that of the ammunition loading position M.

Figure 12:
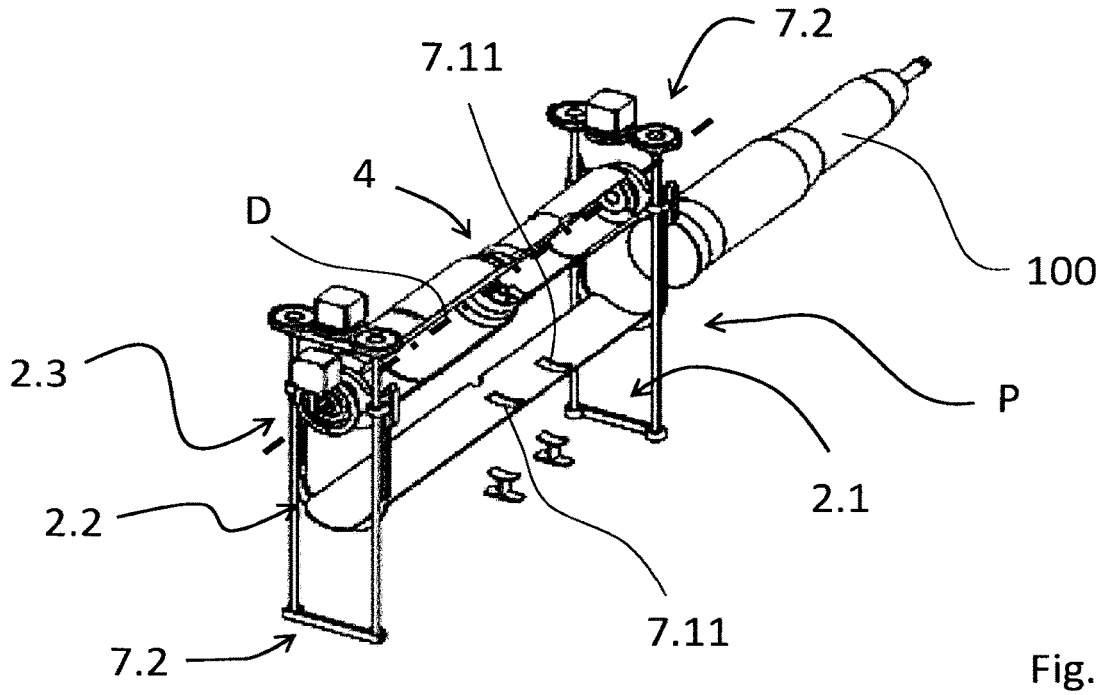
FIG. 12 shows a perspective representation of the ammunition elevator in the removal position.

In FIG. 12 it can also be seen that the receiving shell 7.1 has two rectangular recesses 7.11. The two projectile supports 7.5 may extend through these recesses 7.11 when the receiving shell 7.1 is located in the lowest storage level 2.1. Since the ammunition bodies 100 are narrower in the front part than in the rear part, the projectile supports 7.5 serve to support in particular this narrower front part, since the ammunition bodies 100 in this region cannot rest fully on the cylindrical receiving shell 7.1.

REFERENCE CHARACTERS

1 Magazine
1.1 Base plate
1.2 Base plate
1.3 Rod
1.4 Hole pattern
2 Storage area

2.1 Storage level
2.2 Storage level/Limit level
2.3 Storage level
3 Storage space
4 Retaining apparatus
4.1 Ejection mechanism
4.11 Ejection drive
4.12 Rear toothed segment
4.13 Front toothed segment
4.14 Rear ejection pinion
4.15 Front ejection pinion
4.2 Retaining shell
4.21 End region
4.22 End region
4.3 Retaining shell
4.4 Retaining shell drive
4.5 Gearbox
4.51 Sun wheel
4.52 Hollow wheel
4.53 Planetary wheel
4.54 Bridge
4.55 Gear ring
4.6 Rotary bearing
4.7 Ejection latch
4.71 Front ejection latch
4.72 Rear ejection latch
4.8 Rotary drive
4.9 Retaining shell drive mechanism
4.10 Retaining region
5 Conveying device
5.1 Conveying shaft
5.2 Conveying wheel
5.21 Receiving contours
5.3 Conveying wheel
5.31 Receiving contours
5.4 Strut
5.5 Drive wheel
5.6 Coupling element
5.7 Screw roller
5.71 Screw guide
5.72 Constriction
5.8 Guide rail
6 Level drive
7 Ammunition elevator
7.1 Receiving shell
7.11 Recess
7.2 Linear drive
7.21 Threaded spindle
7.22 Threaded spindle
7.23 Lifting motor
7.24 Gearbox
7.25 Bearing rail
7.3 Linear guide
7.4 Stop
7.5 Projectile support
7.6 Guide element
100 Ammunition body
200 Vehicle
201 Vehicle hull
202 Vehicle turret
203 Weapon
204 Free region
205 Removal space
E Storage direction
A Removal direction
D Rotation axis
H Retaining position
U Transfer position
G Grabbing position
P Removal position
M Ammunition loading position
x1 Segment angle
x2 Segment angle

What is claimed is:

1. Retaining apparatus for ammunition bodies having two retaining shells which are movable relative to one another and which form a retaining region in which an ammunition body can be held, wherein at least one retaining shell can be rotated about a rotation axis, wherein the rotation axis runs through the retaining region, the retaining apparatus further including an ejection mechanism having at least one ejection latch and an ejection drive for moving the ejection latch.

2. The retaining apparatus according to claim 1, wherein both retaining shells are rotatable about the rotation axis.

3. The retaining apparatus according to claim 1 wherein the retaining shells are configured as cylinder segments, central axes of which correspond to the rotation axis.

4. The retaining apparatus according to claim 3, wherein the retaining shells have different segment angles.

5. The retaining apparatus according to claim 1, wherein the two retaining shells can be rotated relative to each other around the rotation axis.

6. The retaining apparatus according to claim 1, wherein the two retaining shells can be moved relative each other by means of a retaining shell drive.

7. The retaining apparatus according to claim 6, wherein the retaining shell drive is connected to both retaining shells by a gearbox having a planetary gear.

8. The retaining apparatus according to claim 1, wherein the two retaining shells can be rotated together around the rotation axis by means of a rotary drive.

9. The retaining apparatus according to claim 1, wherein the two retaining shells are opposite each other in a retaining position, in such a way that an ammunition body is retained between the two retaining shells and the two retaining shells are arranged in a transfer position in such a way that an ammunition body can be ejected from the two retaining shells.

10. The retaining apparatus according to claim 9, wherein the two retaining shells are in contact with each other in the transfer position.

11. The retaining apparatus of claim 1, wherein the ejection drive has a toothed segment coupled to one of the two retaining shells and an ejection pinion rotatably connected to the other retaining shell, wherein with a relative movement of the retaining shells, the toothed segment rotates the ejection pinion and thereby actuates the ejection latch.

12. A magazine having a retaining apparatus according to claim 1.

13. An ammunition elevator having a retaining apparatus according to claim 1.

14. A method for retaining ammunition bodies having a retaining apparatus retaining two retaining shells which are movable relative to one another and which form a retaining region in which an ammunition body is held, wherein at least one of the two retaining shells is rotated about a rotation axis running through the retaining region, the retaining apparatus further including an ejection mechanism having at least one ejection latch and an ejection drive for moving the ejection latch.

* * * * *